US007900302B2

(12) United States Patent
Long

(10) Patent No.: US 7,900,302 B2
(45) Date of Patent: Mar. 8, 2011

(54) ADJUSTABLE BED HAVING SNAP-ON ACTUATOR DRIVE

(75) Inventor: Thomas P. Long, Webb City, MO (US)

(73) Assignee: L&P Property Management Company, South Gate, CA (US)

( * ) Notice: Subject to any disclaimer, the term of this patent is extended or adjusted under 35 U.S.C. 154(b) by 571 days.

(21) Appl. No.: 11/870,148

(22) Filed: Oct. 10, 2007

(65) Prior Publication Data

US 2009/0094748 A1 Apr. 16, 2009

(51) Int. Cl.
*A47B 7/02* (2006.01)

(52) U.S. Cl. ..... 5/618; 5/617

(58) Field of Classification Search ..... 5/613, 616–618; 254/122, 124, 126, 134; 403/386, 397, 399
See application file for complete search history.

(56) References Cited

U.S. PATENT DOCUMENTS 4,649,238 A * 3/1987 Beck et al. ..... 200/16 C
4,749,169 A 6/1988 Pickles
5,438,723 A * 8/1995 Carroll ..... 5/620
5,577,280 A 11/1996 Elliott
5,579,550 A * 12/1996 Bathrick et al. ..... 5/620
5,640,730 A 6/1997 Godette
5,819,345 A 10/1998 Basgall
6,101,647 A * 8/2000 Stroud et al. ..... 5/618
6,163,904 A * 12/2000 Royston ..... 5/618
6,216,295 B1 * 4/2001 Pearson ..... 5/618
6,276,011 B1 * 8/2001 Antinori ..... 5/618
6,393,641 B1 * 5/2002 Hensley ..... 5/618
6,499,162 B1 * 12/2002 Lu ..... 5/618
6,640,365 B1 * 11/2003 Chang ..... 5/618
2006/0163972 A1 7/2006 Dollgast et al.
2007/0163046 A1 * 7/2007 Eriksson et al. ..... 5/618
2008/0276373 A1 * 11/2008 Clenet ..... 5/618
2009/0211028 A1 * 8/2009 Richmond et al. ..... 5/618

* cited by examiner

*Primary Examiner* — Michael Trettel
*Assistant Examiner* — William Kelleher
(74) *Attorney, Agent, or Firm* — Wood, Herron & Evans, LLP

(57) ABSTRACT

An adjustable bed includes an articulated deck comprising head, seat, leg and foot deck boards hingedly joined together and supported from a frame movable relative to a stationary base. An actuator assembly, including a motor driven actuator operatively coupled by snap-fit connectors to the frame, inclines at least one of the deck boards.

15 Claims, 12 Drawing Sheets

ADJUSTABLE BED HAVING SNAP-ON ACTUATOR DRIVE

FIELD OF THE INVENTION

This invention relates generally to adjustable beds and, more particularly, to an adjustable bed having a linear actuator assembly for moving an adjustable portion of the deck of the bed, which linear actuator may be snap-fit onto predetermined elements of the adjustable bed.

BACKGROUND OF THE INVENTION

A well known type of bedding product comprises a motorized adjustable bed in which an articulated frame supports a mattress. These motorized adjustable beds have traditionally been used in hospitals but more and more are being installed and used in residential homes. Motorized adjustable beds have conventionally had an upper body support movable between an inclined position in which it supports the patient in a sitting position and a prone position in which the patient lies down in a generally horizontal position. In addition, a leg support is movable between positions and may be adjusted to a desired degree of inclination. An actuating mechanism, commonly two or more electric motors, raises and lowers the head and leg supports of the articulated bed frame. U.S. Pat. No. 5,640,730 discloses such an adjustable bed.

U.S. Pat. Nos. 6,499,162 and 6,640,365 disclose adjustable beds comprising a plurality of bed plates pivotally secured together for supporting a mattress. Connecting elements or links pivotally connect a base to the bed plates. A movable member slides along the base and is activated by a piston movable from inside a cylinder secured to the base. Activation of a power source such as an electric motor causes movement of the bed plates via movement of the sliding member.

One of the heaviest components of an adjustable bed is the actuator system for effecting movement of the adjustable bed. This actuator system is typically purchased by the manufacturer as a separate component of the knock-down adjustable bed assembly and secured to the remainder of the adjustable bed by the manufacturer using fasteners such as nuts, bolts, screws, fastening pins or other forms of conventional attachment devices. This step in the assembly of the adjustable bed may be labor intensive, time consuming and therefore expensive. Often skilled laborers are required for such assembly.

It has therefore been an objective of this invention to provide an actuator system which may be attached to an adjustable bed as simply as possible and with a minimum of component assembly parts. To that end, and in accordance with this invention, the motorized actuator of this invention may be snap-fit onto portions or elements of an adjustable bed, thereby enabling the actuator to be attached to the adjustable bed without any nuts, bolts, screws or other form of conventional attachment devices.

SUMMARY OF THE INVENTION

This invention comprises an adjustable bed having an adjustable deck for supporting a mattress. The adjustable bed is preferably powered by an electric motor driven linear actuator. However, any other drive assembly, such as a conventional electrical motor driven screw and nut actuator system may be used in accordance with the present invention.

The adjustable bed, in one embodiment, comprises a generally rectangular stationary base comprising a pair of opposed side rails, a head end rail and a foot end rail located at the head and foot ends of the adjustable bed, respectively.

Supports extending downwardly from the head and foot end rails support the base a fixed distance above the floor or supporting surface. Although legs are preferable, other types of supports may be used to raise and/or maintain the stationary base above the supporting surface.

Each of the side rails of the base has a channel built therein. More particularly, each of the side rails of the stationary base has a "C-shaped" cross-sectional configuration which defines the channel.

This adjustable bed further comprises a frame spaced above the stationary base and movable relative to the stationary base. Such an adjustable bed is known in the art as a "wall hugger" adjustable bed. The frame includes a pair of side assemblies joined by transversely extending cross members. Each of the side assemblies of the frame comprises a generally "L-shaped" member comprising a vertically oriented leg portion and a horizontally oriented side portion. A support leg is secured to the horizontally oriented side portion of the generally "L-shaped" member so each side assemblies has two legs. In combination, each side assembly of the movable frame has two legs, each having a roller rotatably secured to the leg at the bottom thereof which travels or moves in one of the channels of one of the side rails of the stationary base.

The adjustable bed further comprises an articulated deck for supporting a mattress or similar product. The articulated deck comprises a head deck board, a seat deck board fixedly secured to the frame, a leg deck board and a foot deck board hingedly joined to each other. The articulated deck is movable between a horizontal position in which all of the deck boards are horizontal and coplanar and a fully inclined position in which the head, leg and foot boards are inclined and the seat deck board remains in its horizontal position and fixed to the movable frame.

The adjustable bed further comprises a pair of head links. Each head link is of a fixed length and is pivotally secured to one of the side rails of the stationary base at one end and pivotally secured to a bracket fixedly secured to the head deck board at its other end. These head links connect the base and the head deck board.

Similarly, a pair of leg links connect the base to the leg deck board. Each leg link is of a fixed length and is pivotally secured to one of the side rails of the stationary base at one end and pivotally secured to a bracket fixedly secured to the leg deck board at its other end.

A pair of foot links connect the movable frame to the foot deck board. Each foot link has an adjustable length but may be manually set to have a predetermined, fixed length. Each foot link is pivotally secured to one of the side rails of the movable frame at one end and pivotally secured to a bracket fixedly secured to the foot deck board at its other end.

A motorized actuator assembly is operatively coupled to the movable frame of the adjustable bed. The motorized actuator assembly functions to move the articulated deck between a first horizontal position in which all of the deck boards are co-planar in a horizontal position and a second fully inclined position in which the head deck board is inclined, the seat deck board generally horizontal, the leg and foot deck boards inclined.

The motorized actuator assembly comprises a motorized actuator secured at one end to one of the cross members of the frame by a first snap-fit connector. The motorized actuator includes a housing tube or cylinder in which moves a rotatable screw powered by a motor protected by a housing. The motorized actuator assembly further comprises a piston or extension tube movable relative to the housing tube, the extension tube being operatively coupled by a second snap-fit connector to a pin extending between a pair of link arms.

These link arms are operatively coupled to a torque tube which is part of the movable frame.

A pair of operating arms are welded or otherwise secured to the torque tube, each of the operating arms having a roller at the end thereof for engaging the head deck board of the articulated deck and raising the head deck board. The linear actuator of the actuator assembly is powered by an electric motor. Activation of the electric motor extends the extension tube relative to the housing tube which, in turn, causes the torque tube to rotate which causes the operating arms to contact and raise the head deck board from its first horizontal position to its second inclined position.

Because the motorized actuator assembly, including the drive motor and linear actuator, are connected by snap-fit connectors to portions of the frame including a torque tube which affects inclination of the headrest portion of the bed, the motorized actuator assembly may be attached to the frame and through an appropriate linkage to the torque tube without any need for special tools or connection devices.

In operation, starting from the first position of the adjustable bed in which the articulated deck is generally horizontal, an operator activates the motorized actuator assembly in any known manner. The electric motor extends the extension tube relative to the housing tube which rotates the torque tube which, in turn, causes the operating arms of the actuator assembly to rotate or pivot about a horizontal axis. Movement of the operating arms causes the rollers at the ends of the operating arms to contact the head deck board to move the head deck board from its first horizontal position to its second inclined position. As the head deck board inclines, the seat deck board moves horizontally towards the head end of the bed with the frame in what is known in the industry as a wall hugger motion. As the seat deck board moves towards the head end of the bed, the leg deck board moves from its first horizontal position to its second inclined position. This movement of the leg deck board causes the foot deck board to incline, its foot edge moving towards the head end of the bed as the foot links pivot about horizontal pivot axes.

The configuration of this embodiment of adjustable bed allows a user to move an upper frame of the adjustable bed relative to a stationary base using rollers traveling in channels in the base. The adjustable bed enables the deck to move between a first horizontal or prone position to a second inclined position with the assistance of the motorized actuator assembly of the articulated bed.

To facilitate assembly of the bed, the motorized actuator assembly has snap-fit connectors attached to the linear actuator of the assembly such that one end of the assembly may be snap-fit attached to a portion of the movable frame, and the opposite end of the linear actuator may be snap-fit attached to a movable component of the assembly, in this case, arms secured to a rotatable torque tube of the assembly. Thereby, ease of assembly and ease of handling of components of the assembly is facilitated.

In alternative embodiments of adjustable beds, multiple motorized actuator assemblies each having snap-fit connectors may be used to quicken the assembly process and lessen assembly costs. Such adjustable beds may include wall hugger adjustable beds in which an upper carriage or frame moves relative to a stationary base and non wall hugger adjustable beds in which the upper carriage or frame remains fixed relative to a stationary base.

These and other objects and advantages of the present invention will be more readily apparent from the following drawings.

DETAILED DESCRIPTION OF THE DRAWINGS

Figure 1:
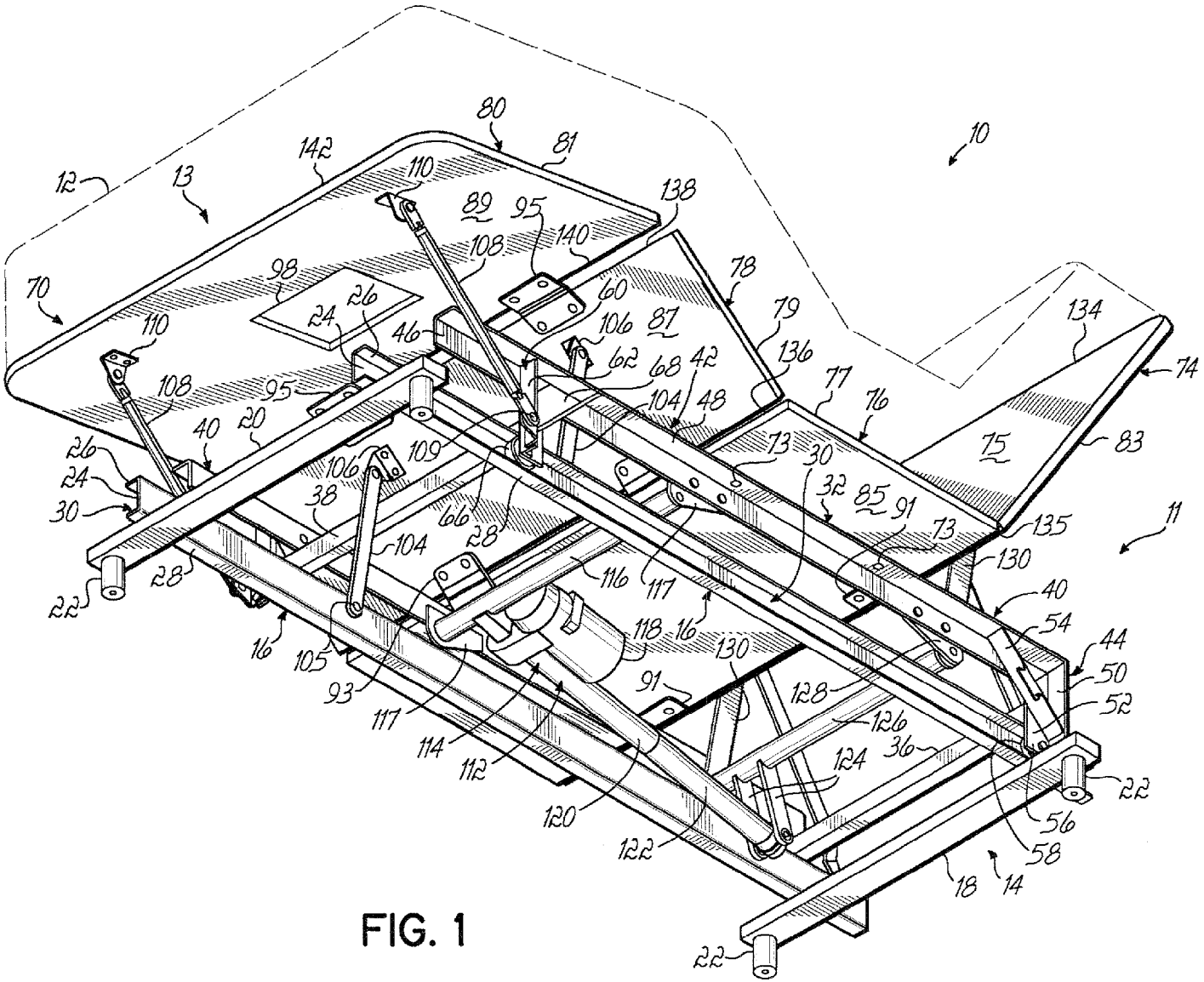
FIG. 1 is a bottom perspective view of an adjustable bed made in accordance with this invention in a fully inclined position supporting a mattress shown in phantom.

Referring to the drawings, and particularly to FIG. 1, there is illustrated an adjustable bed 10 including a mattress 12. The adjustable bed 10 may be used to support any type of mattress including an air mattress, a coil spring mattress or any other type of mattress. The mattress 12 does not form a part of the present invention.

Figure 2:
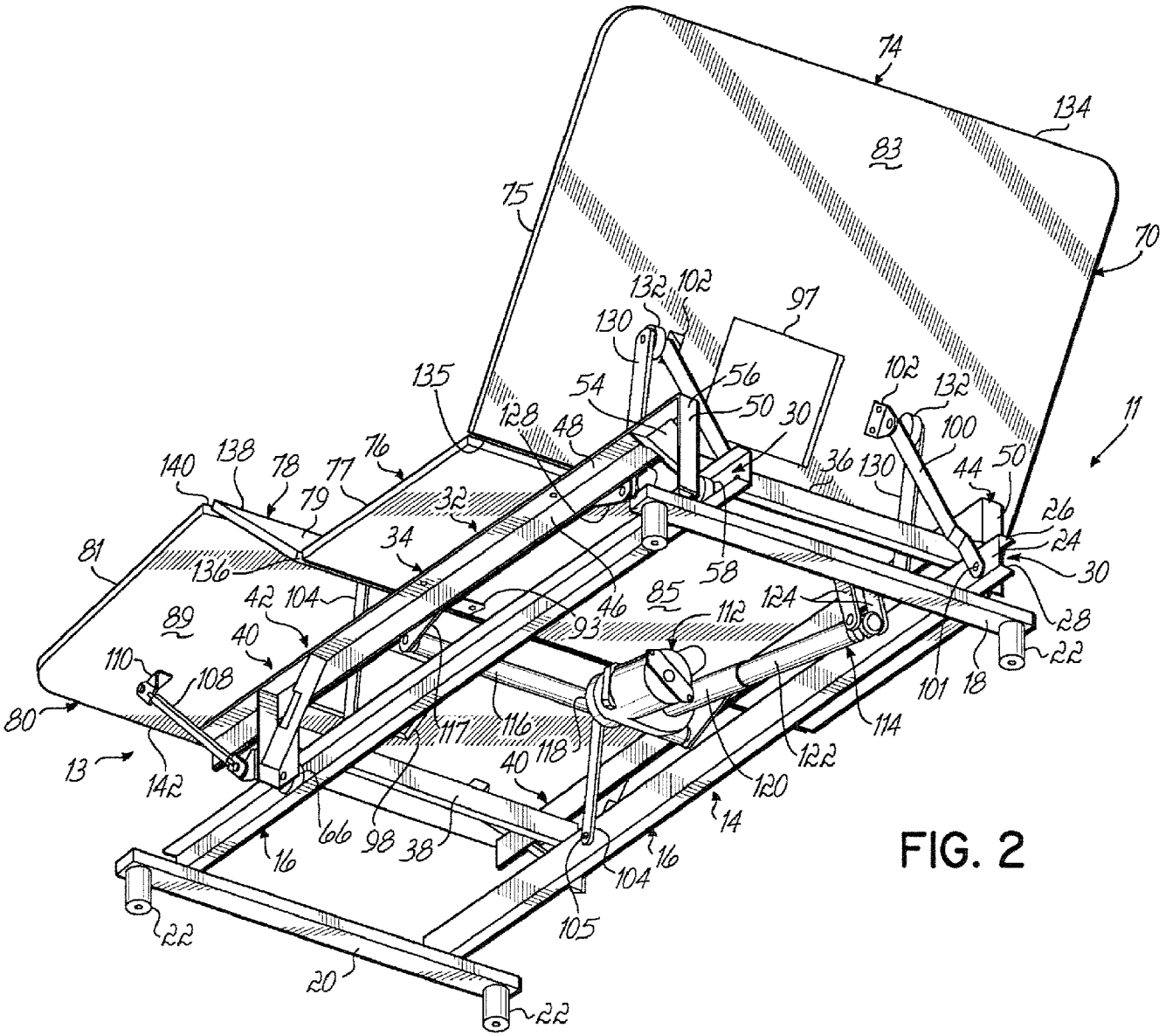
FIG. 2 is another bottom perspective view of the adjustable bed of FIG. 1 without the mattress in a fully inclined position.
Figure 3:
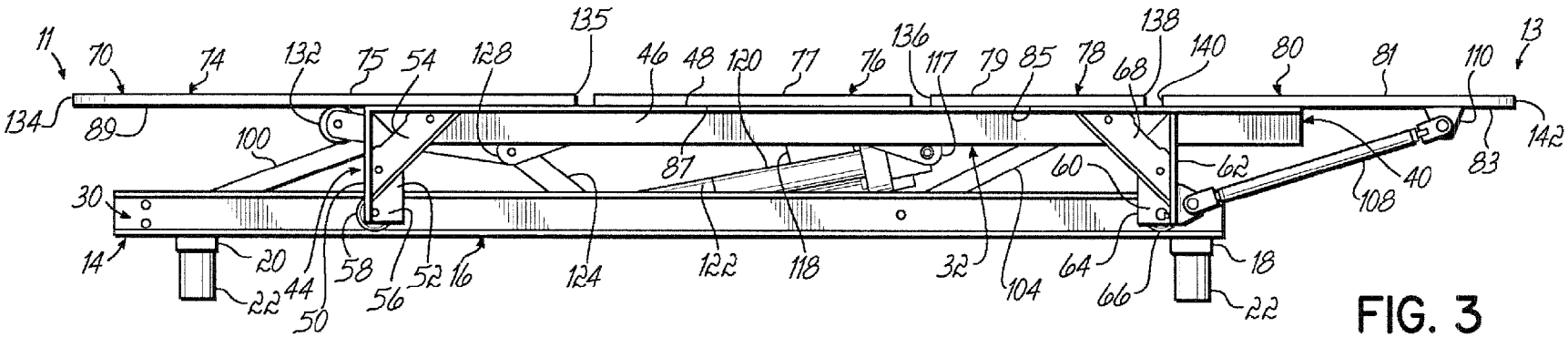
FIG. 3 is a side elevational view of the adjustable bed of FIG. 1 without the mattress in a horizontal position.
Figure 4:
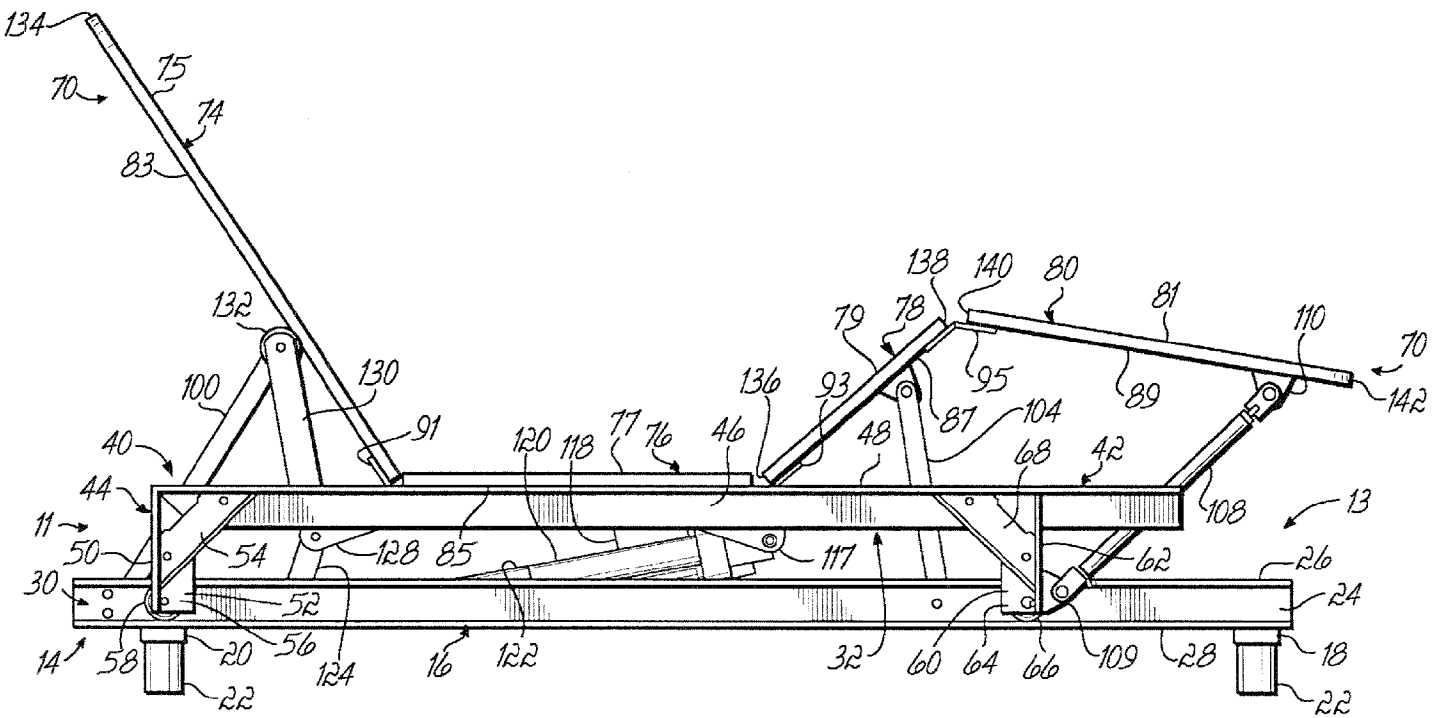
FIG. 4 is a side elevational view of the adjustable bed of FIG. 1 without the mattress in a fully inclined position.

The adjustable bed 10 has a head end 11 and a foot end 13. The adjustable bed 10 is movable between a first horizontal position shown in FIG. 3 and a fully inclined position as shown in FIGS. 1, 2 and 4. Typically, an operator or user sleeps with the adjustable bed in its first horizontal position and reads or watches television with the adjustable bed in its fully inclined position. However, the adjustable bed 10 may assume any intermediate position between the extreme positions illustrated and maintained in such a position.

The adjustable bed 10 comprises a stationary generally rectangular base 14 comprising a pair of opposed side rails 16, a head end rail 18, a foot end rail 20 and four legs 22 supporting the base 14 a fixed distance about a floor or supporting surface (not shown). The head and foot end rails 18, 20, respectively, each are secured to each side rail 16 and extend therebetween. The head and foot end rails 18, 20, respectively, are illustrated being rectangular in cross-section. However, they may be any desired size or shape, hollow or solid. The legs 22 are shown secured and extending downwardly from the head and foot end rails 18, 20, respectively, but may be secured to the side rails 16 if desired. Although a cylindrical shaped leg 22 is illustrated, any configuration or length of leg or similar support may be used.

As shown in FIG. 1, each of the side rails 16 of the base 14 has a generally C-shaped cross-sectional configuration including a vertically oriented side portion 24, a horizontally oriented top portion 26 extending outwardly from the upper edge of the side portion 24 and a horizontally oriented bottom portion 28 extending outwardly from the lower edge of the side portion 24. The side, top and bottom portions, 24, 26 and 28, respectively, define an outwardly facing channel 30 in each side rail 16 of the base 14. Although each side rail 16 is illustrated having a generally C-shaped cross-sectional configuration along its entire length, any desired configuration or length of side rail may be used in the base. For example, the channels may be shaped differently than those illustrated.

The adjustable bed 10 further comprises a frame 32 movable relative to the stationary base 14. The frame 32 is movable between a first position shown in FIG. 3 when the adjustable bed 10 is in its first horizontal position and a second position shown in FIGS. 1, 2 and 4 when the adjustable bed 10 is in its fully inclined position as shown in FIGS. 1, 2 and 4. In its first position shown in FIG. 3, the frame 32 is located proximate the foot end 13 of the bed (to the right as shown in FIG. 3). In its second position shown in FIG. 4, the frame 32 is located proximate the head end 11 of the bed (to the left as shown in FIG. 4).

As shown in the drawings, the movable frame 32 comprises a pair of side assemblies 34 connected by front and rear cross members 36, 38, respectively. Each of the front and rear cross members 36, 38, respectively, are joined to each side assembly 34 and extends therebetween. The front and rear cross members 36, 38, respectively, of the movable frame 32 are illustrated being rectangular in cross-section. However, they may be any desired size or shape, hollow or solid.

Each of the side assemblies 34 of the movable frame 32 comprises a generally "L-shaped" member 40 having a horizontal portion 42 and a vertical leg portion 44 at the head end 11 of the adjustable bed 10 extending downwardly from the horizontal portion 42 of the generally "L-shaped" member 40. The horizontal portion 42 has a vertical flange 46 and a horizontal flange 48 while the vertical leg portion 44 has a first flange 50, a continuation of the horizontal flange 48 and a second flange 52, a continuation of the vertical flange 46. Thus, each portion 42, 44 of each generally "L-shaped" member 40 has an "L-shaped" cross sectional configuration.

A front brace 54 extends between the horizontal portion 42 and the vertical leg portion 44 of the generally "L-shaped" member 40. The brace 54 is riveted, welded or otherwise secured to the vertical flange 46 of the horizontal portion 42 and the second flange 52 of the leg portion 44 of the generally "L-shaped" member 40. Although one configuration of front brace 54 is illustrated, other configurations or styles of braces may be used.

For purposes of this document, the vertical leg portion 44 of each generally "L-shaped" member 40 of the movable frame 32 may be referred to as a front leg 56 which has a front roller 58 rotatably secured at the bottom thereof, each front roller 58 being sized and adapted to travel inside the channel 30 of one of the side rails 16 of the stationary base 14. The front roller 58 is rotatably secured to the second flange 52 of the front leg 56.

Each of the side assemblies 34 further comprises a support or rear leg 60 having a first flange 62 and a second flange 64 at right angles or orthogonal to each other. Thus, the support or rear leg 60 has a cross sectional configuration which is generally "L-shaped." The first flange 62 of the rear leg 60 is parallel the first flange 50 of the front leg 56 while the second flange 64 of the rear leg 60 is parallel the second flange 52 of the front leg 56. A rear roller 66 is rotatably secured to the second flange 64 of the rear leg 60 of each side assembly 34 of the movable frame 32. Each rear roller 66 is sized and adapted to travel inside the channel 30 of one of the side rails 16 of the stationary base 14.

A rear brace 68 extends between the horizontal portion 42 of the generally "L-shaped" member 40 and the rear leg 60. The rear brace 68 is riveted, welded or otherwise secured to the vertical flange 46 of the horizontal portion 42 of the generally "L-shaped" member 40 and the second flange 64 of the rear leg 60 of each side assembly 34. Although one configuration of rear brace 68 is illustrated, other braces may be used.

Portions of an articulated deck 70 are operatively coupled to the movable frame 32 with a plurality of connectors 72 and a portion of the articulated deck 70 is operatively coupled to the movable frame 32 with fasteners 73. The articulated deck 70 comprises a head deck board 74, a seat deck board 76, a leg deck board 78 and a foot deck board 80. Each of the deck boards is preferably the same width but any two deck boards may be different widths, if desired. Deck boards 74, 76, 78 and 80 have upper surfaces 75, 77, 79 and 81, respectively, and lower surfaces 83, 85, 87 and 89, respectively.

As best illustrated in FIGS. 1 and 2, the head deck board 74 is hingedly secured to the seat deck board 76 with hinges 91 secured to the lower surfaces 83, 85 of the head and seat deck boards 74, 76, respectively. Similarly, seat deck board 76 is hingedly secured to leg deck board 78 with hinges 93 secured to the lower surfaces 85, 87 of the seat and leg deck boards 76,78, respectively. Leg deck board 78 is hingedly secured to foot deck board 80 with hinges 95 secured to the lower surfaces 87, 89 of the leg and foot deck boards 78, 80, respectively. Although, two hinges 91 are shown in FIGS. 1 and 4 securing the head deck board 74 to the seat deck board 76, any number of hinges may be used including one continuous hinge. The same applies to hinges 93 and 95 connecting the other deck boards.

The deck boards 74, 76, 78 and 80 are preferably made of plywood, but may be made of plastic, oriented strand board or any other material.

As illustrated in FIG. 2, the head deck board 74 has a rectangular hole 97 therein which may be used to mount a massage unit (not shown) as is common in the industry. Similarly, as illustrated in FIG. 1, the foot deck board 80 has a rectangular hole 98 therein which may be used to mount a massage unit (not shown) as is common in the industry.

As illustrated in FIG. 1, the seat deck board 76 is fixedly secured to the movable frame 32 with fasteners 73. More particularly, the fasteners 73 pass through holes in the horizontal flange 48 of the horizontal portion 42 of each side assembly 34 of the movable frame 32 and into the material of the seat deck board 76. Thus, the seat deck board 76 remains flat and fixed in the same location relative to the movable frame 32. When the movable frame 32 moves, the seat deck board 76 moves with it.

The adjustable bed 10 further comprises connectors 72 in the form of links of fixed length which limit the travel of the movable frame 32 relative to the stationary base 14 and limit the movement of the articulated deck 70. As shown in the drawings, the adjustable bed 10 has two head links 100 each of the same fixed length and each pivotally secured at its lower end to one of the side rails 16 of the stationary base 14 with a fastener 101 so that each pivots about a horizontal pivot axis. See FIG. 2. At its upper end each of head links 100 is pivotally secured to a bracket 102 fixedly secured to the lower surface 83 of the head deck board 74. Each head link 100 also pivots about a horizontal axis.

Similarly, two leg links 104 or connectors, each of the same fixed length, are each pivotally secured at a lower end to one of the side rails 16 of the stationary base 14 with a fastener 105 so that each pivots about a horizontal pivot axis. See FIG. 1. Each leg link 104 is pivotally secured at its upper end to a bracket 106 fixed to the lower surface 87 of the leg deck board 78 and also pivots about a horizontal axis.

As illustrated in FIGS. 1, 3 and 4, two foot links 108 or connectors, each of the same fixed length, are each pivotally secured at a lower end to one of the rear legs 60 of the side assemblies 34 of the movable frame 32 with fastener 109 so that each pivots about a horizontal pivot axis. See FIG. 1. Each foot link 108 is pivotally secured at its upper end to a bracket 110 fixed to the lower surface 89 of the foot deck board 80.

The articulated deck 70 is moved by a motorized linear actuator assembly 112 between a first position shown in FIG. 3 in which the deck boards 74, 76, 78 and 80 are generally co-planar in a horizontal position or orientation and a second position shown in FIGS. 1, 2 and 4. In the second position, the head deck board 74 is inclined, the seat deck board 76 is substantially horizontal and fixed to the movable frame 32, the leg deck board 78 inclined and the foot deck board 80 slightly inclined.

The motorized linear actuator assembly 112 is part of the movable frame 32 and moves with the movable frame 32 relative to the stationary base 14. The motorized linear actuator assembly 112 comprises a motorized linear actuator 114 fixedly secured to a mounting cross member 116 of the movable frame 32 by a snap-fit connector 150 best illustrated in FIGS. 5-7. This mounting cross member 116 forms part of the movable frame 32 and is secured to and extends between two brackets 117. Each bracket 117 is secured to a vertical flange 46 of the horizontal portion 42 of one of the generally L-shaped members 40 of one of the side assemblies 34 of the movable frame 32. Thus, the motorized linear actuator 114 moves with the movable frame 32 because it is mounted to the mounting cross member 116 which forms part of the movable frame 32.

Figure 8:
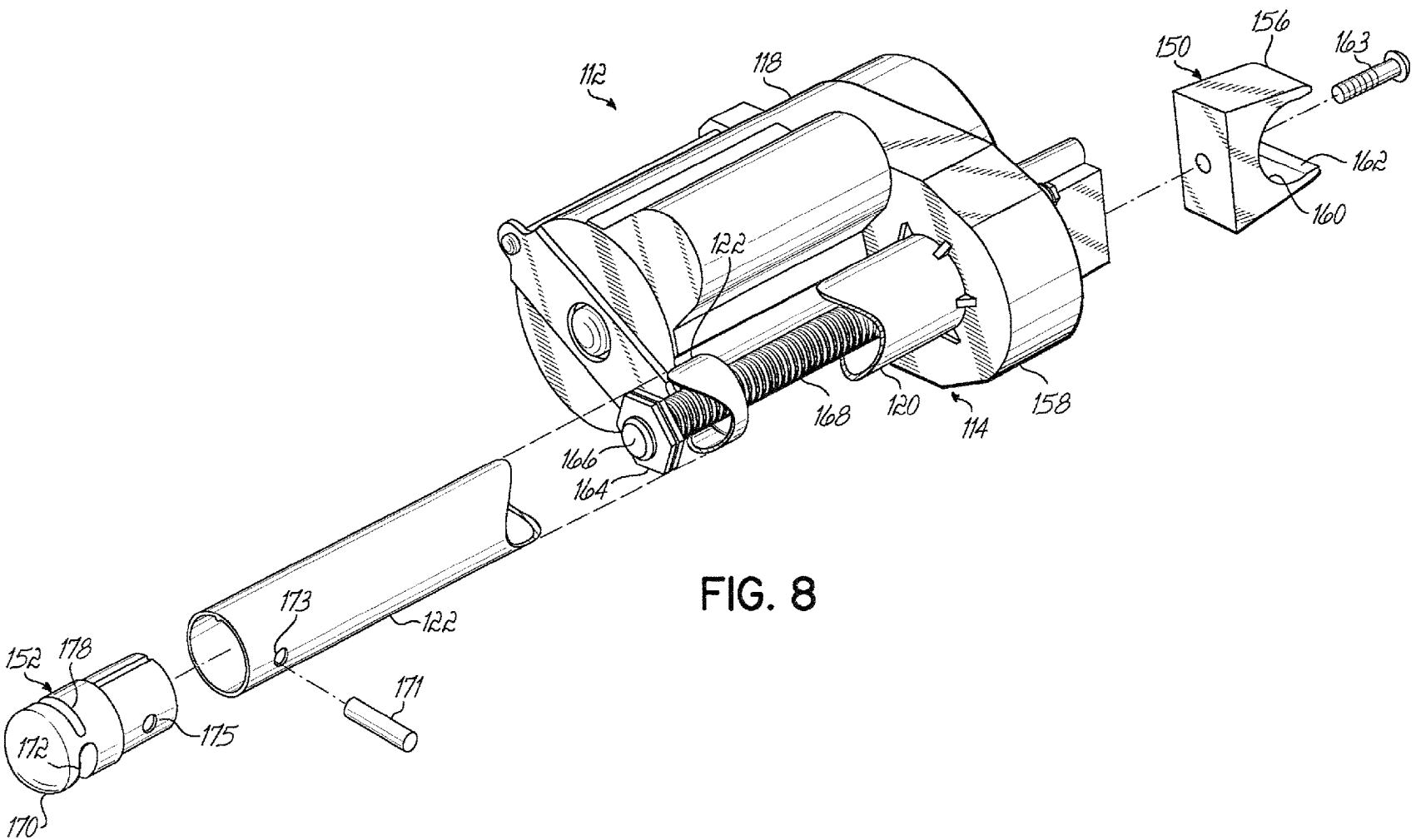
FIG. 8 is a partially exploded perspective view of the linear actuator assembly of the adjustable bed.

As shown in FIG. 8, the motorized linear actuator 114 comprises an AC motor 118, a housing tube 120 and an extension tube 122 extendable from inside the housing tube 120. A nut 164 having a threaded interior hole 166 is fixed at a specific location inside the extension tube 122. A threaded screw 168 rotated by the motor 118 moves the nut 164 along a portion of the axial length of the threaded screw 168. As the nut 164 moves along the length of threaded screw 168, the extension tube 122 moves relative to the fixed position of the housing tube 120.

The motorized linear actuator assembly 112 further comprises a snap-fit connector 152 secured to the end of extension tube 122. The snap-fit connector 152 is receivable over a pin 154 extending between a pair of spaced link arms 124 (see FIGS. 1-6). Each link arm 124 is welded or secured at its upper end to a rotatable or pivotal torque tube 126 so that the torque tube 126 is pivotally secured to the extension tube 122 of the motorized linear actuator 114 through the snap-fit connector 152 and pin 154. The torque tube 126 is, in turn, mounted between brackets 128, each bracket 128 being secured to a vertical flange 46 of the horizontal portion 42 of the generally L-shaped member or rail 40 of one of the side assemblies 34 of the movable frame 32. Thus, the torque tube 126 is part of the motorized linear actuator assembly 112, comprises part of the movable frame 32 and moves with the movable frame 32. The torque tube 126 has a pair of spaced operating arms 130 extending upwardly therefrom, each arm 130 being a fixed length and having a roller 132 at the end thereof for engaging the lower surface 83 of the head deck board 74. See FIG. 4. Each operating arm 130 is welded or otherwise fixedly secured to the torque tube 126 at its lower end.

In use of the linear actuator 112, the output of the electric motor 118 extends the extension tube 122 which pivots or rotates the torque tube 126 which, in turn, raises the operating arms 130 and causes the rollers 132 to contact and push upwardly the head deck board 74. The electric motor 118 may be remotely controlled or controlled in any known manner.

Although any type of linear actuator may be used, one which has proven satisfactory is a motorized linear actuator available from Hubbell Special Products Incorporated of Pleasant Prairie, Wis. sold under Part Number 7011954, Model MC42 1007H.

With reference now to FIGS. 5-8, there is illustrated in greater detail the snap-fit connection of the motorized linear actuator 112 to the cross bar 116 at one end and to the pin 154 extending between link arms 124 secured to the torque tube 126 at its opposite end.

Figure 5:
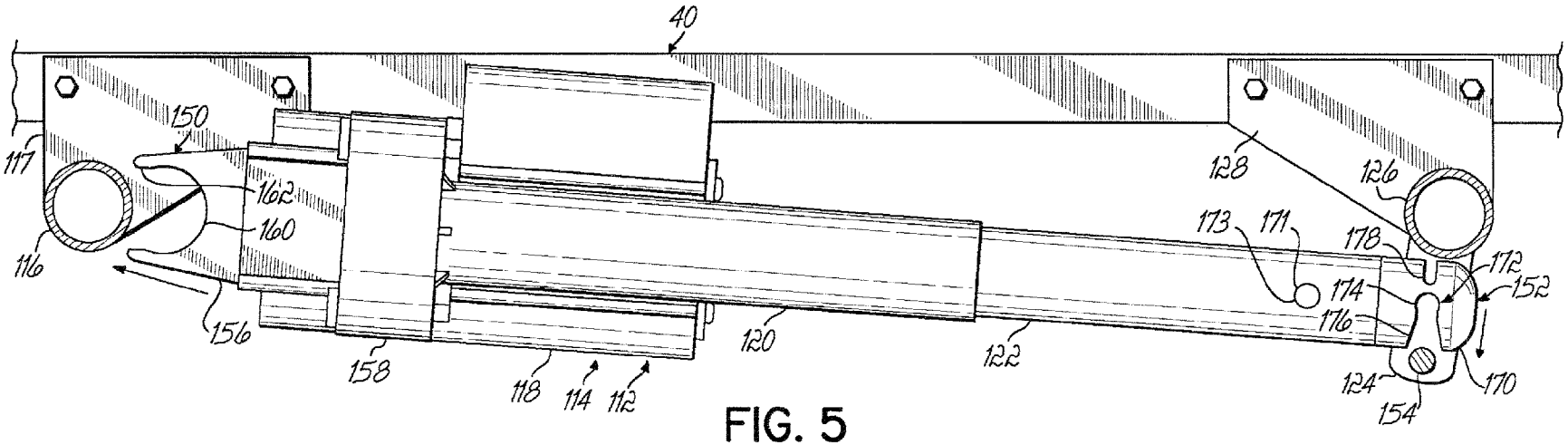
FIG. 5 is a side elevational view, partially in cross section, of the linear actuator assembly portion of the bed with the actuator assembly disconnected from the components of the adjustable bed to which it is ultimately attached.
Figure 6:
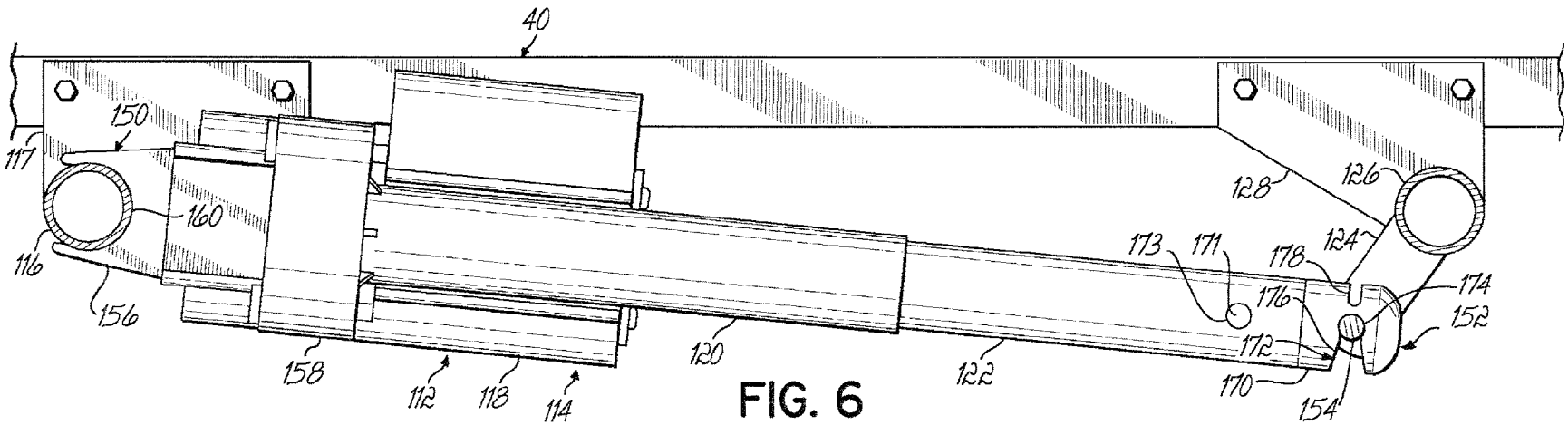
FIG. 6 is a view similar to FIG. 5, but showing the actuator assembly attached to the adjustable bed components.
Figure 7:
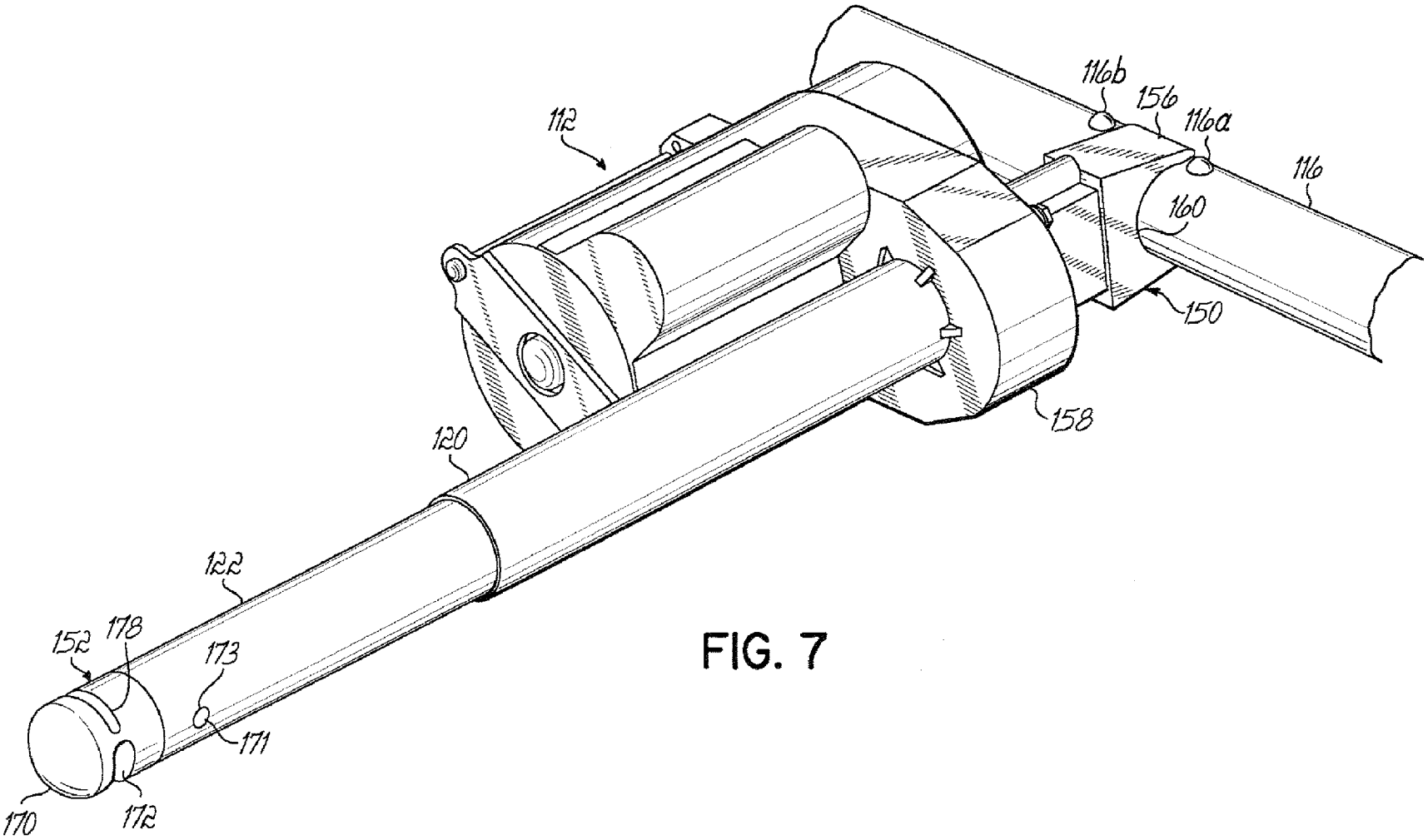
FIG. 7 is a perspective view of the linear actuator assembly of the adjustable bed.

As may be seen in these FIGS. 5-8, the snap-fit connector 150 at the foot end of the actuator 112 comprises a shaped plastic block 156 of nylon or other similar plastic material fixedly secured to the housing 158 of the motorized linear actuator 112 by a screw 163. This block 156 has an arcuate transversely extending recess 160 extending therethrough, which arcuate recess extends through an arc of approximately 220°. This recess is, in turn, intersected by a slot 162 which extends from the end of the block into the arcuate recess 160. This slot 162 is slightly smaller in width 5 than the diameter of the cross bar 116. And the diameter of the arcuate slot 160 is slightly larger than the outside diameter of the circular cross section cross bar 116. So dimensioned, and as illustrated in FIGS. 5 and 6, this block 156 may be snap-fit over the cross bar 116 and thereby secured thereto. Preferably, and as illustrated in FIG. 7, there are dimples 116*a*, 116*b* formed on the cross bar or cross member 116 so as to prevent lateral movement of the block on the cross bar 116 once the block 156 is snap-fit over the cross bar.

Again, still with reference to FIGS. 5-8, it will be seen that the snap-fit connector 152 at the opposite end of the motorized linear actuator 112 comprises a generally cylindrically shaped plastic block of nylon or other similar plastic material 170, which is fixedly attached to the outer end of the extension tube 122 by a transversely extending pin 171 and, for example, a tapered pin which extends through aligned holes 173, 175 of the extension tube 122 and connector 152, respectively. This block 152 has a generally keyhole-shaped slot 172 formed on the underside thereof for reception over the pin 154. This keyhole-shaped slot 172 comprises a transverse arcuate section 174 which is intersected by an upwardly tapered section 176 of the slot 172. Arcuate section 174 of the slot also extends for approximately 220° with the narrowest portion of the slot adjacent the arcuate section being slightly smaller in width than the diameter of the pin 154 such that when the extension tube 122 of the actuator 112 is forced downwardly, it may snap-fit over and secure the extension tube 122 to the pin 154. Thereby, the actuator 112 is secured to the pin 154 and through the link arms 124 to the torque tube 126. Preferably, there is a small slot 178 in the nylon block on the opposite side from the keyhole-shaped slot 172 which facilitates flexing of the nylon block so as to better enable the connector 152 to be snap-fit over the pin 154.

Because of these snap-fit connections of the motorized linear actuator 112 to the cross bar 116 of the movable frame 32 and to the torque tube 126 via the pin 154 and the links 124 which extend between the pin 154 and the torque tube 126, the linear actuator 112 may be easily and quickly assembled eliminating the need for any fasteners. This can be very advantageous because of the difficulty of handling a complete adjustable bed and/or if shipped in a disassembled condition, of assembling it via conventional connectors. This invention eliminates all need for such connectors and facilitates assembly of the adjustable bed.

In operation, starting from the first position of the adjustable bed 10 shown in FIG. 3 in which the articulated deck 70 is generally horizontal, an operator (not shown) activates the motorized linear actuator assembly 112 with or without a remote (not shown). Activation of the electric motor 118 extends the extension tube 122 relative to the housing tube 120 which rotates the torque tube 126 via links 124. Rotation or pivoting the torque tube 126 causes the operating arms 130 of the actuator assembly 112 to rotate or pivot about a horizontal axis parallel the torque tube 126. The rollers 132 located at the upper ends of the operating arms 130 contact the head deck board 74 and move it from its first horizontal position shown in FIG. 3 to its second fully inclined position shown in FIG. 4 in which the head edge 134 of the head deck board 74 is above the rear edge 135 of the head deck board 74.

As the head deck board 74 inclines, the seat deck board 76 and movable frame 32 move towards the head end 11 of the bed (to the left in FIGS. 3 and 4), causing or pulling the leg deck board 78 horizontally towards the head end 11 of the bed. The leg deck board 78 also moves towards the head end 11 of the bed 10, from its first horizontal position shown in FIG. 3 to its second fully inclined position shown in FIG. 4. In this fully inclined position, the front edge 136 of the leg deck board 78 is lower than the rear edge 138 of the leg deck board 78. This movement of the leg deck board 78 causes or pulls the foot deck board 80 towards the head end 11 of the bed as the connectors 72 and in particular the foot links 108 are pivoted about horizontal pivot axes in a counterclockwise direction as viewed in FIGS. 3 and 4. In its fully inclined position shown in FIG. 4, the front edge 140 of the foot deck board 80 is higher than the rear edge 142 of the foot deck board 80.

As desired, the adjustable bed 10 may be moved from its fully inclined position shown in FIG. 4 (in which the front edge 134 of the head deck board 74 is above the rear edge 135 of the head deck board 74) back to its horizontal position shown in FIG. 3 via use of the motorized linear actuator assembly 112.

FIGS. 9-12 illustrate an alternative embodiment of adjustable bed 10*a* utilizing two motorized linear actuator assemblies and known in the art as a wall hugger adjustable bed. For purposes of simplicity, like parts are identified with like numbers but an "a" designation in the description of this embodiment relative to the embodiment of adjustable bed shown in FIGS. 1-4 having only one motorized linear actuator assembly 12.

The adjustable bed 10*a* has a head end 11 a and a foot end 13*a*. The adjustable bed 10*a* is movable between a first horizontal position shown in FIG. 11 and a fully inclined position shown in FIGS. 9, 10 and 12.

The adjustable bed 10*a* comprises a stationary generally rectangular base 14*a*, like base 14, comprising a pair of opposed side rails 16*a*, a head end rail 18*a*, a foot end rail 20*a* and four legs 22*a* supporting the base 14*a* a fixed distance about a floor or supporting surface (not shown). The head and foot end rails 18*a*, 20*a*, respectively, each are secured to each side rail 16*a* and extend therebetween. The head and foot end rails 18*a*, 20*a*, respectively, are illustrated being rectangular in cross-section. However, they may be any desired size or shape, hollow or solid. The legs 22*a* are shown secured and extending downwardly from the head and foot end rails 18*a*, 20*a*, respectively, but may be secured to the side rails 16*a*. Although a cylindrical shaped leg 22*a* is illustrated, any configuration or length of leg or similar support may be used.

Figure 9:
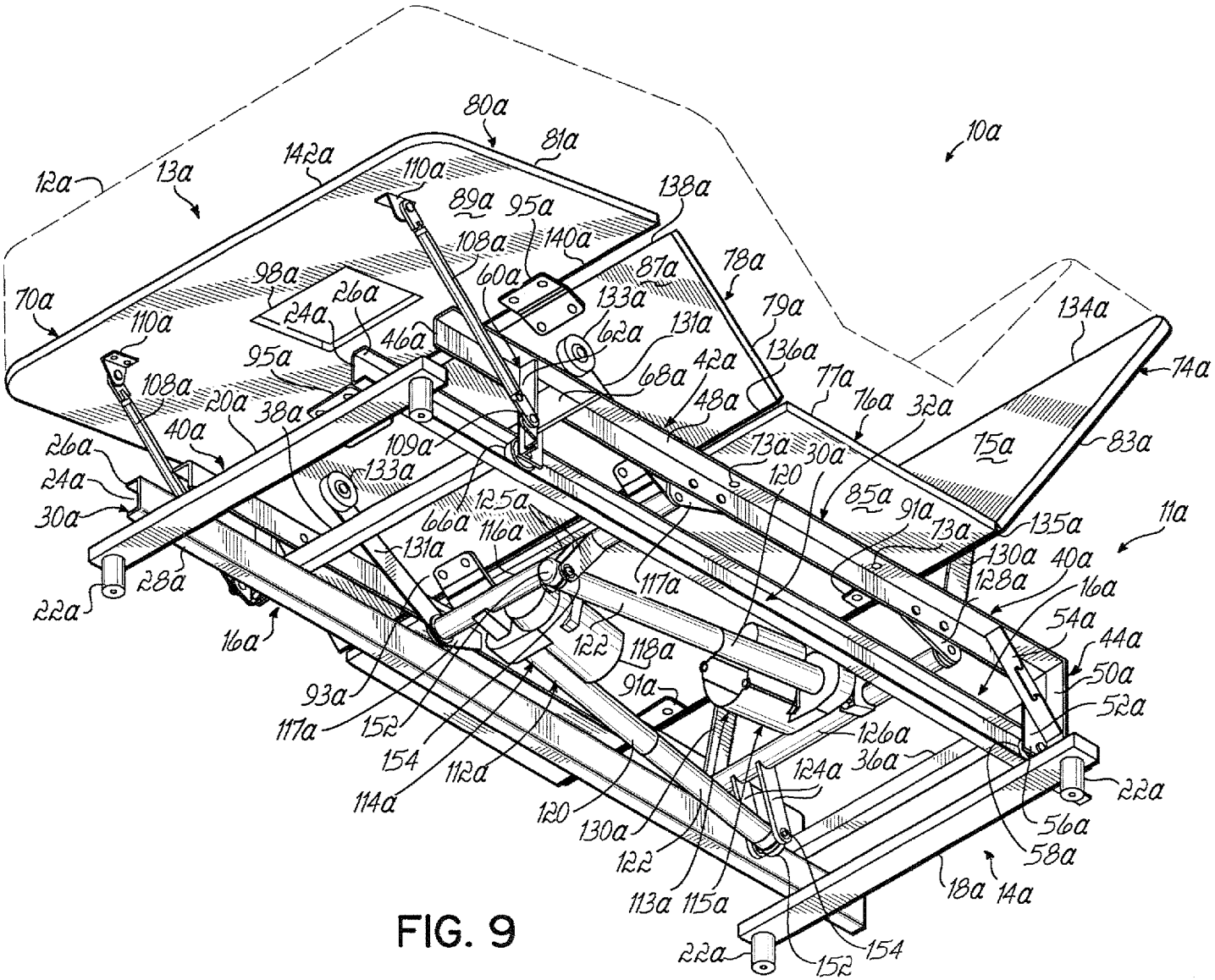
FIG. 9 is a bottom perspective view of an alternative embodiment of adjustable bed made in accordance with this invention in a fully inclined position supporting a mattress shown in phantom.

As shown in FIG. 9, each of the side rails 16*a* of the base 14*a* has a generally C-shaped cross-sectional configuration including a vertically oriented side portion 24*a*, a horizontally oriented top portion 26*a* extending outwardly from the upper edge of the side portion 24*a* and a horizontally oriented bottom portion 28*a* extending outwardly from the lower edge of the side portion 24*a*. The side, top and bottom portions, 24*a*, 26*a* and 28*a*, respectively, define an outwardly facing channel 30*a* in each side rail 16*a*. Although each side rail 16*a* is illustrated having a generally C-shaped cross-sectional configuration along its entire length, any desired configuration or length of side rail may be used in the base. For example, the channels may be shaped differently than those illustrated.

Figure 11:
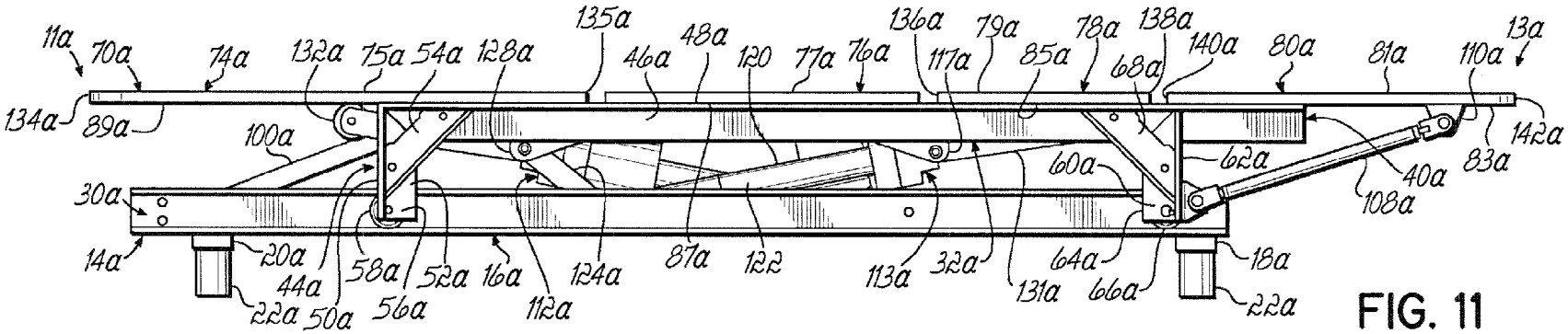
FIG. 11 is a side elevational view of the adjustable bed of FIG. 9 without the mattress in a horizontal position.
Figure 12:
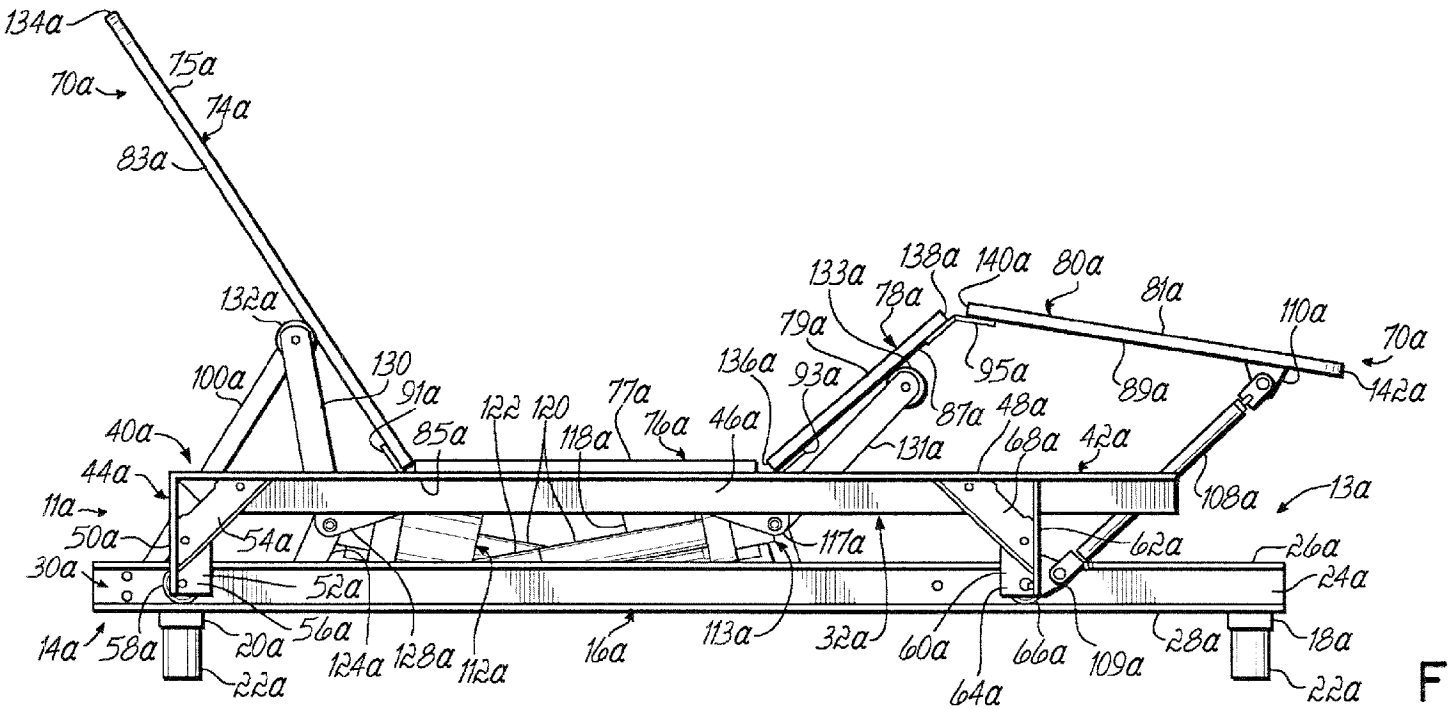
FIG. 12 is a side elevational view of the adjustable bed of FIG. 9 without the mattress in a fully inclined position.

The adjustable bed 10*a* further comprises an upper carriage or frame 32*a* movable relative to the stationary base 14*a* to prove wall hugger action. The frame 32*a* is movable between a first position shown in FIG. 11 when the adjustable bed 10*a* is in its first horizontal position and a second position shown in FIGS. 9, 10 and 12 when the adjustable bed 10*a* is in its fully inclined position. In its first position shown in FIG. 11, the movable frame 32*a* is located proximate the foot end 13*a* of the bed (to the right as shown in FIG. 11). In its second position shown in FIG. 12, the frame 32*a* is located proximate the head end 11*a* of the bed (to the left as shown in FIG. 12).

The movable frame 32*a* comprises a pair of side assemblies 34*a* connected by front and rear cross members 36*a*, 38*a*, respectively. See FIGS. 9 and 10. Each of the front and rear cross members 36*a*, 38*a*, respectively, are joined to each side assembly 34*a* and extends therebetween. The front and rear cross members 36*a*, 38*a*, respectively, of the movable frame 32*a* are illustrated being rectangular in cross-section. However, they may be any desired size or shape, hollow or solid.

Each of the side assemblies 34*a* of the movable frame 32*a* comprises a generally "L-shaped" member 40*a* having a horizontal portion 42*a* and a vertical leg portion 44*a* at the head end 11*a* of the adjustable bed 10*a* extending downwardly from the horizontal portion 42*a* of the generally "L-shaped" member 40*a*. The horizontal portion 42*a* has a vertical flange 46*a* and a horizontal flange 48*a* while the vertical leg portion 44*a* has a first flange 50*a*, a continuation of the horizontal flange 48*a* and a second flange 52*a*, a continuation of the vertical flange 46*a*. Thus, each portion 42*a*, 44*a* of each generally "L-shaped" member 40*a* has an "L-shaped" cross sectional configuration.

A front brace 54*a* extends between the horizontal portion 42*a* and the vertical leg portion 44*a* of the generally "L-shaped" member 40*a*. The brace 54*a* is riveted, welded or otherwise secured to the vertical flange 46*a* of the horizontal portion 42*a* and the second flange 52*a* of the leg portion 44*a* of the generally "L-shaped" member 40*a*. Although one configuration of front brace 54*a* is illustrated, other configurations or styles of braces may be used.

For purposes of this document, the vertical leg portion 44*a* of each generally "L-shaped" member 40*a* of the movable frame 32*a* may be referred to as a front leg 56*a* which has a front roller 58*a* rotatably secured at the bottom thereof, each front roller 58*a* being sized and adapted to travel inside the channel 30*a* of one of the side rails 16*a* of the stationary base 14*a*. The front roller 58*a* is rotatably secured to the second flange 52*a* of the front leg 56*a*.

Each of the side assemblies 34*a* further comprises a support or rear leg 60*a* having a first flange 62*a* and a second flange 64*a* at right angles or orthogonal to each other. Thus, the support or rear leg 60*a* has a cross sectional configuration which is generally "L-shaped." The first flange 62*a* of the rear leg 60*a* is parallel the first flange 50*a* of the front leg 56*a* while the second flange 64*a* of the rear leg 60*a* is parallel the second flange 52*a* of the front leg 56*a*. A rear roller 66*a* is rotatably secured to the second flange 64*a* of the rear leg 60*a* of each side assembly 34*a* of the movable frame 32*a*. Each rear roller 66*a* is sized and adapted to travel inside the channel 30*a* of one of the side rails 16*a* of the stationary base 14*a*.

A rear brace 68*a* extends between the horizontal portion 42*a* of the generally "L-shaped" member 40*a* and the rear leg 60*a*. The rear brace 68*a* is riveted, welded or otherwise secured to the vertical flange 46*a* of the horizontal portion 42*a* of the generally "L-shaped" member 40*a* and the second flange 64*a* of the rear leg 60*a* of each side assembly 34*a*. Although one configuration of rear brace 68*a* is illustrated, other braces may be used.

Portions of an articulated deck 70*a* are operatively coupled to the movable frame 32*a* with a plurality of connectors 72*a* and a seat deck board 76*a* of the articulated deck 70*a* is operatively coupled to the movable frame 32*a* with fasteners 73*a*. The articulated deck 70*a* comprises a head deck board 74*a*, a seat deck board 76*a*, a leg deck board 78*a* and a foot deck board 80*a*. Each of the deck boards is preferably the same width but any two deck boards may be different widths, if desired. Deck boards 74*a*, 76*a*, 78*a* and 80*a* have upper surfaces 75*a*, 77*a*, 79*a* and 81*a*, respectively, and lower surfaces 83*a*, 85*a*, 87*a* and 89*a*, respectively.

As illustrated in FIG. 9, the head deck board 74*a* is hingedly secured to the seat deck board 76*a* with hinges 91*a* secured to the lower surfaces 83*a*, 85*a* of the head and seat deck boards 74*a*, 76*a*, respectively. Similarly, seat deck board 76*a* is hingedly secured to leg deck board 78*a* with hinges 93*a* secured to the lower surfaces 85*a*, 87*a* of the seat and leg deck boards 76*a*, 78*a*, respectively. Leg deck board 78*a* is hingedly secured to foot deck board 80*a* with hinges 95*a* secured to the lower surfaces 87*a*, 89*a* of the leg and foot deck boards 78*a*, 80*a*, respectively. Although, two hinges 91*a* are shown in FIGS. 9 and 12 securing the head deck board 74*a* to the seat deck board 76*a*, any number of hinges may be used including one continuous hinge. The same applies to hinges 93*a* and 95*a* connecting the other deck boards. The deck boards 74*a*, 76*a*, 78*a* and 80*a* are preferably made of plywood, but may be made of plastic, oriented strand board or any other material.

Figure 10:
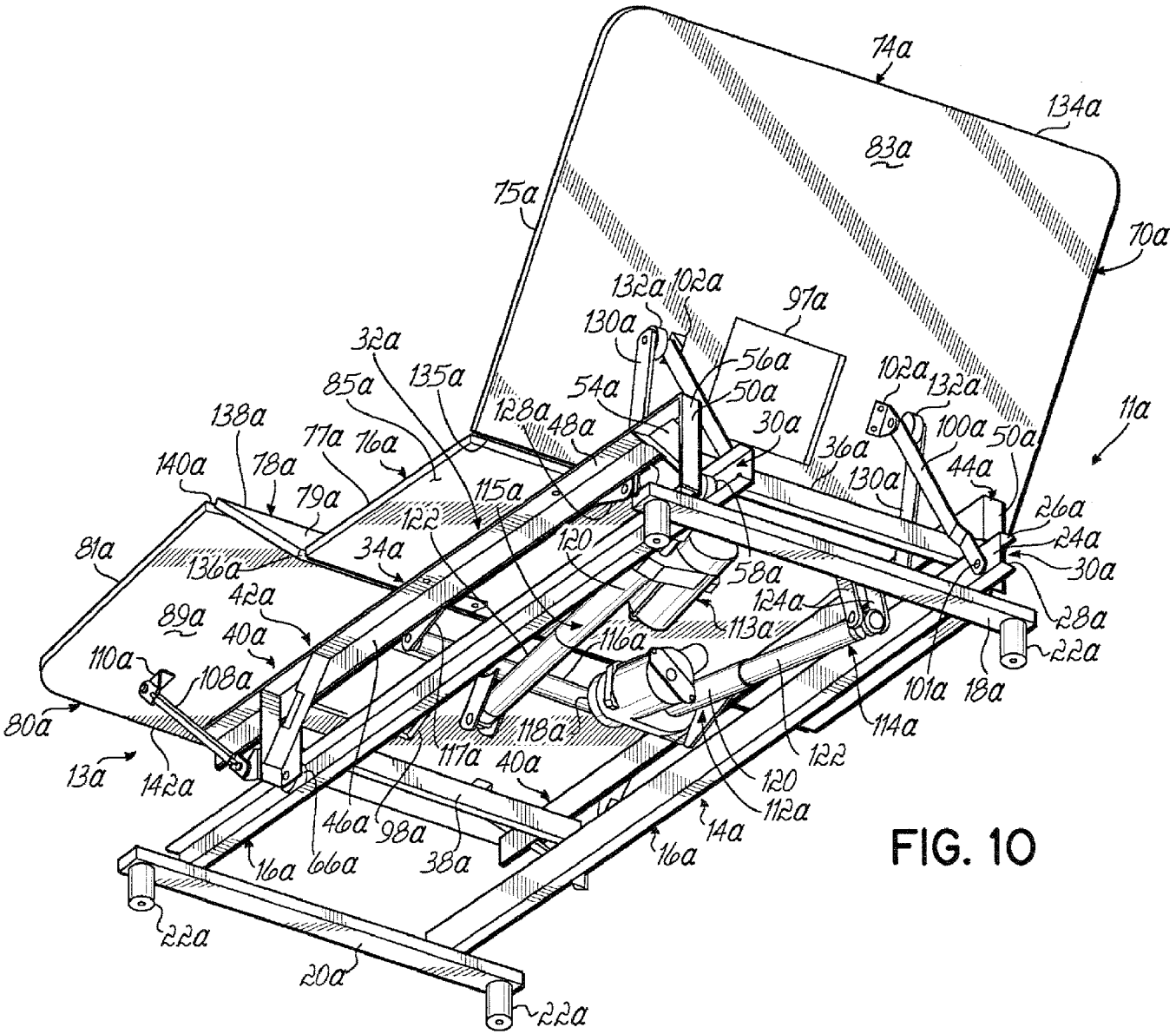
FIG. 10 is another bottom perspective view of the adjustable bed of FIG. 9 without the mattress in a fully inclined position.

As illustrated in FIG. 10, the head deck board 74*a* has a rectangular hole 97*a* therein which may be used to mount a massage unit (not shown) as is common in the industry. Similarly, as illustrated in FIG. 9, the foot deck board 80*a* has a rectangular hole 98*a* therein which may be used to mount a massage unit (not shown) as is common in the industry.

As illustrated in FIG. 9, the seat deck board 76*a* is fixedly secured to the movable frame 32*a* with fasteners 73*a*. More particularly, the fasteners 73*a* pass through holes in the horizontal flange 48*a* of the horizontal portion 42*a* of each side assembly 34*a* of the movable frame 32*a* and into the material of the seat deck board 76*a*. Thus, the seat deck board 76*a* remains flat and fixed in the same location relative to the movable frame 32*a*. When the movable frame 32*a* moves, the seat deck board 76*a* moves with it.

The adjustable bed 10*a* further comprises connectors 72*a* in the form of links of fixed length which limit the travel of the movable frame 32*a* relative to the stationary base 14*a* and limit the movement of the articulated deck 70*a*. As shown in FIG. 2, the adjustable bed 10*a* has two head links 100*a* each of the same fixed length and each pivotally secured at its lower end to one of the side rails 16*a* of the stationary base 14*a* with a fastener 101*a* so that each pivots about a horizontal pivot axis. At its upper end each of head links 100*a* is pivotally secured to a bracket 102*a* fixedly secured to the lower surface 83*a* of the head deck board 74*a*. Each head link 100*a* also pivots about a horizontal axis.

As illustrated in FIGS. 9, 11 and 12, two foot links 108*a* or connectors, each of the same fixed length, are each pivotally secured at a lower end to one of the rear legs 60*a* of the side assemblies 34*a* of the movable frame 32*a* with fastener 109*a* so that each pivots about a horizontal pivot axis. See FIG. 9. Each foot link 108*a* is pivotally secured at its upper end to a bracket 110*a* fixed to the lower surface 89*a* of the foot deck board 80*a*.

The articulated deck 70*a* is moved by two motorized linear actuator assemblies 112*a*, 113*a* between a first position shown in FIG. 11 in which the deck boards 74*a*, 76*a*, 78*a* and 80*a* are generally co-planar in a horizontal position or orientation and a second position shown in FIGS. 9, 11 and 12. In the second position, the head deck board 74*a* is inclined, the seat deck board 76*a* is substantially horizontal and fixed to the movable frame 32*a*, the leg deck board 78*a* inclined and the foot deck board 80*a* slightly inclined.

In this embodiment of wall hugger adjustable bed 10*a*, each motorized linear actuator assembly 112*a*, 113*a* is part of the movable frame 32*a* and moves with the movable frame 32*a* relative to the stationary base 14*a*.

The first motorized linear actuator assembly 112*a* comprises a first motorized linear actuator 114*a* secured to a first rotatable or pivotal torque tube 116*a* of the movable frame 32*a* by a snap-fit connector 150 like the one illustrated in FIGS. 5-7. The first torque tube 116*a* forms part of the movable frame 32*a* and is secured to and extends between two brackets 117*a*. Each bracket 117*a* is secured to a vertical flange 46*a* of the horizontal portion 42*a* of one of the generally L-shaped members 40*a* of one of the side assemblies 34*a* of the movable frame 32*a*. Thus, the motorized linear actuator 114*a* moves with the movable frame 32*a* because it is mounted by a snap-fit connector 150 to the first torque tube 16*a* which forms part of the movable frame 32*a*.

The first motorized linear actuator 114*a* is identical to the motorized linear actuator 114 shown in detail in FIGS. 5-8 and comprises an AC motor 118 in a housing 158, a housing tube 120 and an extension tube 122 extendable from inside the housing tube 120 in the manner described above and shown in the drawings, particularly FIGS. 5-10.

The first motorized linear actuator assembly 112*a* further comprises a snap-fit connector 152 secured to the end of extension tube 122 and receivable over a pin 154 extending between a pair of spaced link arms 124*a* (see FIGS. 9-12). Each link arm 124*a* is welded or secured at its upper end to a second rotatable or pivotal torque tube 126*a* so that the torque tube 126*a* is pivotally secured to the extension tube 122 of the motorized linear actuator 114*a* through the snap-fit connector 152 and pin 154. The torque tube 126*a* is, in turn, mounted between brackets 128*a* (see FIG. 9), each bracket 128*a* being secured to a vertical flange 46*a* of the horizontal portion 42*a* of the generally L-shaped member or rail 40*a* of one of the side assemblies 34*a* of the movable frame 32*a*. Thus, the second torque tube 126*a* is part of the first motorized linear actuator assembly 112*a* and moves with the movable frame

32*a*. The second torque tube 126*a* has a pair of spaced operating arms 130*a* extending upwardly therefrom, each arm 130*a* being a fixed length and having a roller 132*a* at the end thereof for engaging the lower surface 83*a* of the head deck board 74*a*. See FIGS. 9 and 12. Each operating arm 130*a* is welded or otherwise fixedly secured to the second torque tube 126*a* at its lower end.

The second motorized linear actuator assembly 113*a* comprises a second motorized linear actuator 115*a* secured to second torque tube 126*a* of the movable frame 32*a* by a snap-fit connector 150 as illustrated in FIGS. 5-7. The second motorized linear actuator 115*a*, like the first motorized linear actuator 114*a*, moves with the movable frame 32*a*. The second motorized linear actuator 115*a* is identical to the motorized linear actuator 114 shown in detail in FIGS. 5-8 and comprises an AC motor 118, a housing tube 120 and an extension tube 122 extendable from inside the housing tube 120 in the manner described above and shown in the drawings.

The second motorized linear actuator assembly 113*a* further comprises a snap-fit connector 152 secured to the end of extension tube 122 and receivable over a pin 154 extending between a pair of spaced link arms 125*a* (see FIGS. 1-5 and 6). Each link arm 125*a* is welded or secured at its upper end to first rotatable torque tube 116*a* so that the first torque tube 116*a* is pivotally secured to the extension tube 122 of the motorized linear actuator 115*a* through the snap-fit connector 152 and pin 154. The first torque tube 116 is, in turn, mounted between brackets 117*a*, each bracket 117*a* being secured to a vertical flange 46*a* of the horizontal portion 42*a* of the generally L-shaped member or rail 40*a* of one of the side assemblies 34*a* of the movable frame 32*a*. Thus, the first torque tube 116*a* is part of the first and second motorized linear actuator assemblies 114*a*, 115*a* and moves with the movable frame 32*a*. The first torque tube 116*a* has a pair of spaced operating arms 131*a* extending upwardly therefrom, each operating arm 131*a* being a fixed length and having a roller 133*a* at the end thereof for engaging the lower surface 87*a* of the leg deck board 78*a*. See FIG. 12. Each operating arm 131*a* is welded or otherwise fixedly secured to the first torque tube 116*a* at its lower end.

FIGS. 13-16 illustrate an alternative embodiment of adjustable bed 10*b* utilizing two motorized linear actuator assemblies. This adjustable bed 10*b* is not considered a wall hugger adjustable bed because the frame does not move relative to the base. For purposes of simplicity, like parts are identified with like numbers but a "b" designation in the description of this embodiment. The adjustable bed 10*b* has a head end 11*b* and a foot end 13*b*. The adjustable bed 10*b* is movable between a first horizontal position shown in FIG. 15 and a fully inclined position shown in FIGS. 13, 14 and 16.

The adjustable bed 10*b* comprises a stationary generally rectangular base 14*b*, like base 14, comprising a pair of opposed side rails 16*b*, a head end rail 18*b*, a foot end rail 20*b* and four legs 22*b* supporting the base 14*b* a fixed distance about a floor or supporting surface (not shown). The head and foot end rails 18*b*, 20*b*, respectively, each are secured to each side rail 16*b* and extend therebetween. The head and foot end rails 18*b*, 20*b*, respectively, are illustrated being rectangular in cross-section. However, they may be any desired size or shape, hollow or solid. The legs 22*b* are shown secured and extending downwardly from the head and foot end rails 18*b*, 20*b*, respectively, but may be secured to the side rails 16*b*. Although a cylindrical shaped leg 22*b* is illustrated, any configuration or length of leg or similar support may be used.

Figure 13:
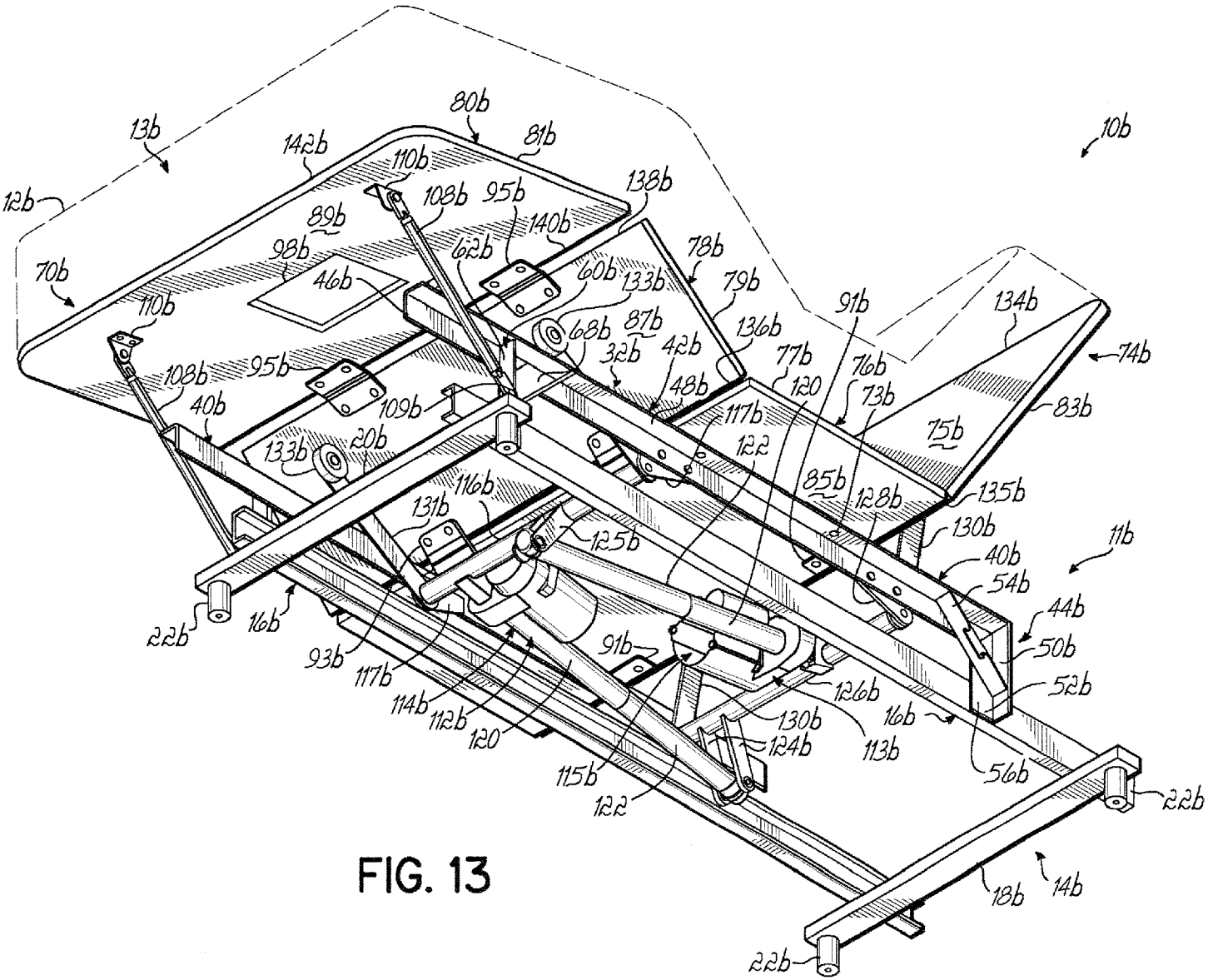
FIG. 13 is a bottom perspective view of an alternative embodiment of adjustable bed in a fully inclined position supporting a mattress shown in phantom.

As shown in FIG. 13, each of the side rails 16*b* of the base 14*b* has a generally C-shaped cross-sectional configuration including a vertically oriented side portion 24*b*, a horizontally oriented top portion 26*b* extending outwardly from the upper edge of the side portion 24*b* and a horizontally oriented bottom portion 28*b* extending outwardly from the lower edge of the side portion 24*b*. The side, top and bottom portions, 24*b*, 26*b* and 28*b*, respectively, define an inwardly facing channel 30*b* in each side rail 16*b* (opposite the direction of the channels 30 and 30*a*). Although each side rail 16*b* is illustrated having a generally C-shaped cross-sectional configuration along its entire length, any desired configuration or length of side rail may be used in the base. For example, the channels may be shaped differently than those illustrated.

The adjustable bed 10*b* further comprises an upper carriage or frame 32*b* welded or otherwise fixed relative to the stationary base 14*b*. The frame 32*b* comprises a pair of side assemblies 34*b*. Each of the side assemblies 34*b* of the frame 32*b* comprises a generally "L-shaped" member 40*b* having a horizontal portion 42*b* and a vertical leg portion 44*b* at the head end 11*b* of the adjustable bed 10*b* extending downwardly from the horizontal portion 42*b* of the generally "L-shaped" member 40*b*. The horizontal portion 42*b* has a vertical flange 46*b* and a horizontal flange 48*b* while the vertical leg portion 44*b* has a first flange 50*b*, a continuation of the horizontal flange 48*b* and a second flange 52*b*, a continuation of the vertical flange 46*b*. Thus, each portion 42*b*, 44*b* of each generally "L-shaped" member 40*b* has an "L-shaped" cross sectional configuration.

A front brace 54*b* extends between the horizontal portion 42*b* and the vertical leg portion 44*b* of the generally "L-shaped" member 40*b*. The brace 54*b* is riveted, welded or otherwise secured to the vertical flange 46*b* of the horizontal portion 42*b* and the second flange 52*b* of the leg portion 44*b* of the generally "L-shaped" member 40*b*. Although one configuration of front brace 54*b* is illustrated, other configurations or styles of braces may be used.

For purposes of this document, the vertical leg portion 44*b* of each generally "L-shaped" member 40*b* of the frame 32*b* may be referred to as a front leg 56*b* which is welded at the bottom thereof, to one of the side rails 16*b* of the base 14*b*.

Each of the side assemblies 34*b* further comprises a support or rear leg 60*b* having a first flange 62*b* and a second flange 64*b* at right angles or orthogonal to each other. Thus, the support or rear leg 60*b* has a cross sectional configuration which is generally "L-shaped." The first flange 62*b* of the rear leg 60*b* is parallel the first flange 50*b* of the front leg 56*b* while the second flange 64*b* of the rear leg 60*b* is parallel the second flange 52*b* of the front leg 56*b*. The second flange 64*b* of the rear leg 60*a* of each side assembly 34*a* of the frame 32*a* is welded to one of the side rails 16*b* of the base 14*b*.

A rear brace 68*b* extends between the horizontal portion 42*b* of the generally "L-shaped" member 40*b* and the rear leg 60*b*. The rear brace 68*b* is riveted, welded or otherwise secured to the vertical flange 46*b* of the horizontal portion 42*b* of the generally "L-shaped" member 40*b* and the second flange 64*b* of the rear leg 60*b* of each side assembly 34*b*. Although one configuration of rear brace 68*b* is illustrated, other braces may be used.

Portions of an articulated deck 70*b* are operatively coupled to the frame 32*b* with a plurality of connectors 72*a* and a seat deck board 76*b* of the articulated deck 70*b* is operatively coupled to the frame 32*b* with fasteners 73*b*. The articulated deck 70*b* comprises a head deck board 74*b*, a seat deck board 76*b*, a leg deck board 78*b* and a foot deck board 80*b*. Each of the deck boards is preferably the same width but any two deck boards may be different widths, if desired. Deck boards 74*b*,

76*b*, 78*b* and 80*b* have upper surfaces 75*b*, 77*b*, 79*b* and 81*b*, respectively, and lower surfaces 83*b*, 85*b*, 87*b* and 89*b*, respectively.

As illustrated in FIG. 13, the head deck board 74*b* is hingedly secured to the seat deck board 76*b* with hinges 91*b* secured to the lower surfaces 83*b*, 85*b* of the head and seat deck boards 74*b*, 76*b*, respectively. Similarly, seat deck board 76*b* is hingedly secured to leg deck board 78*b* with hinges 93*b* secured to the lower surfaces 85*b*, 87*b* of the seat and leg deck boards 76*b*, 78*b*, respectively. Leg deck board 78*b* is hingedly secured to foot deck board 80*b* with hinges 95*b* secured to the lower surfaces 87*b*, 89*b* of the leg and foot deck boards 78*b*, 80*b*, respectively. Although, two hinges 91*b* are shown in FIG. 13 securing the head deck board 74*b* to the seat deck board 76*b*, any number of hinges may be used including one continuous hinge. The same applies to hinges 93*b* and 95*b* connecting the other deck boards. The deck boards 74*b*, 76*b*, 78*b* and 80*b* are preferably made of plywood, but may be made of plastic, oriented strand board or any other material.

Figure 14:
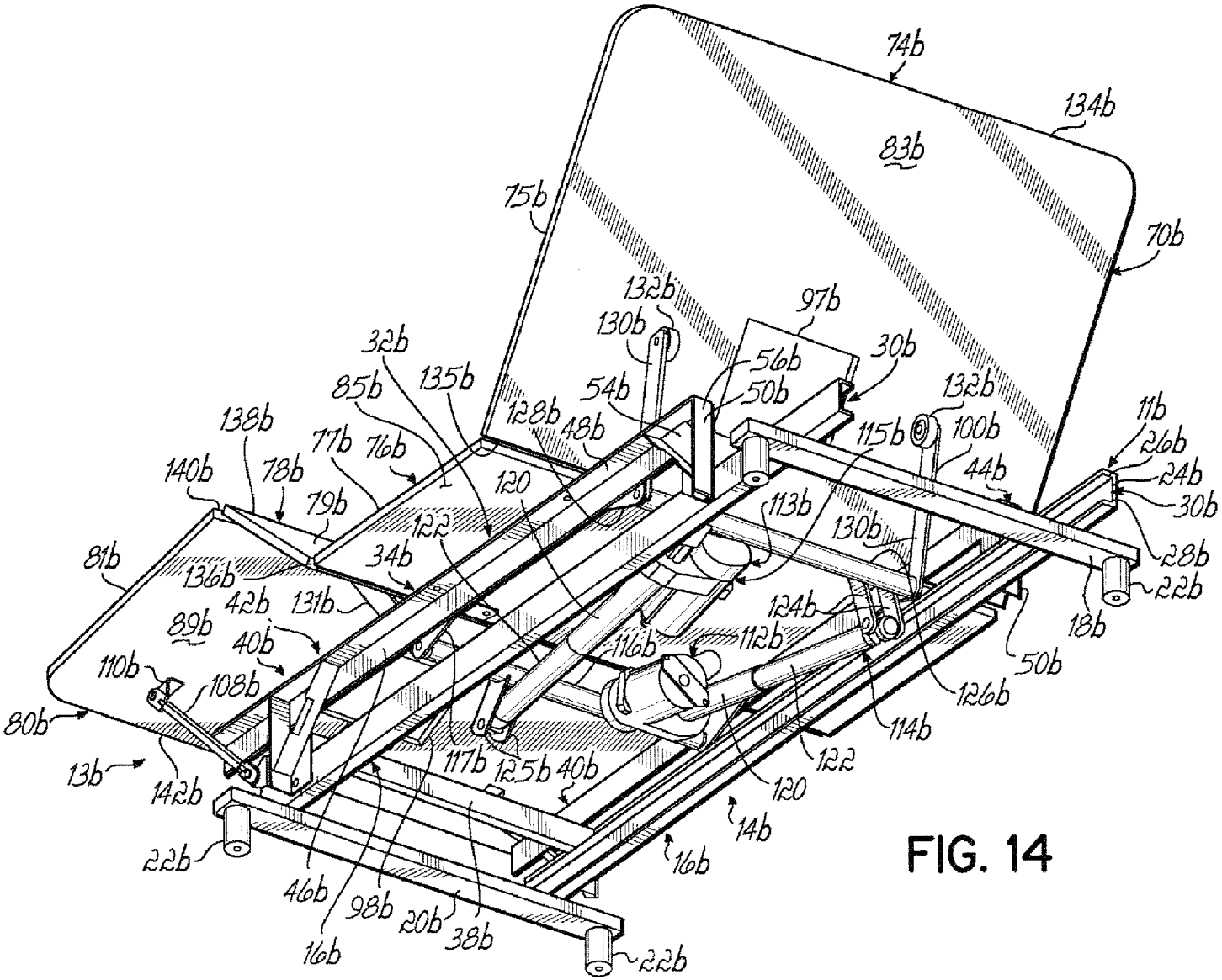
FIG. 14 is another bottom perspective view of the adjustable bed of FIG. 13 without the mattress in a fully inclined position.

As illustrated in FIG. 14, the head deck board 74*b* has a rectangular hole 97*b* therein which may be used to mount a massage unit (not shown) as is common in the industry. Similarly, as illustrated in FIG. 13, the foot deck board 80*b* has a rectangular hole 98*b* therein which may be used to mount a massage unit (not shown) as is common in the industry.

As illustrated in FIG. 13, the seat deck board 76*b* is fixedly secured to the frame 32*b* with fasteners 73*b*. More particularly, the fasteners 73*b* pass through holes in the horizontal flange 48*b* of the horizontal portion 42*b* of each side assembly 34*b* of the movable frame 32*b* and into the material of the seat deck board 76*b*. Thus, the seat deck board 76*b* remains flat and fixed in the same location relative to the frame 32*b*.

The adjustable bed 10*b* further comprises connectors 72*b* in the form of links of fixed length which limit the movement of the articulated deck 70*b*. As shown in FIG. 14, the adjustable bed 10*b* has two head links 100*b* each of the same fixed length and each pivotally secured at its lower end to one of the side rails 16*b* of the stationary base 14*b* with a fastener 101*b* so that each pivots about a horizontal pivot axis. At its upper end each of head links 100*b* is pivotally secured to a bracket 102*b* fixedly secured to the lower surface 83*b* of the head deck board 74*b*. Each head link 100*b* also pivots about a horizontal axis.

Figure 15:
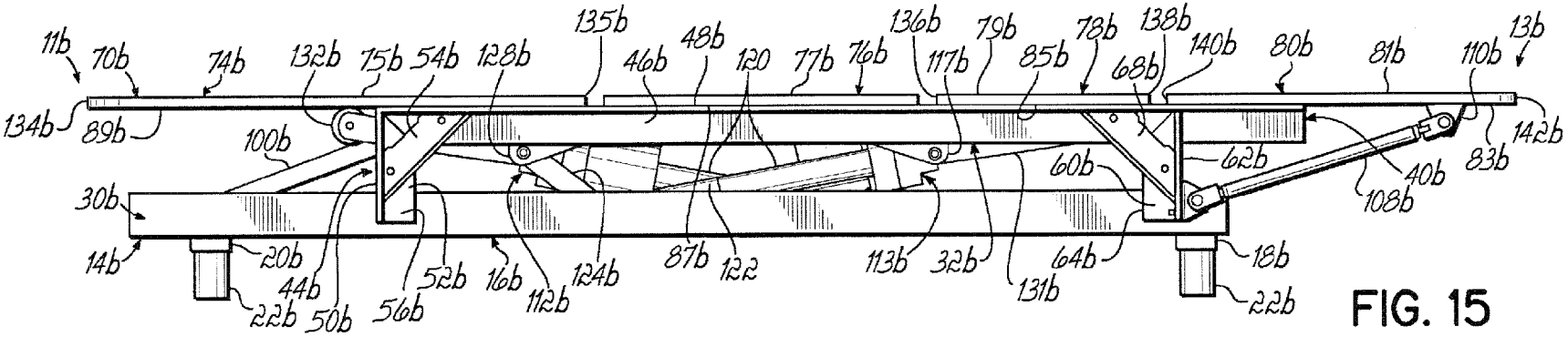
FIG. 15 is a side elevational view of the adjustable bed of FIG. 9 without the mattress in a horizontal position.
Figure 16:
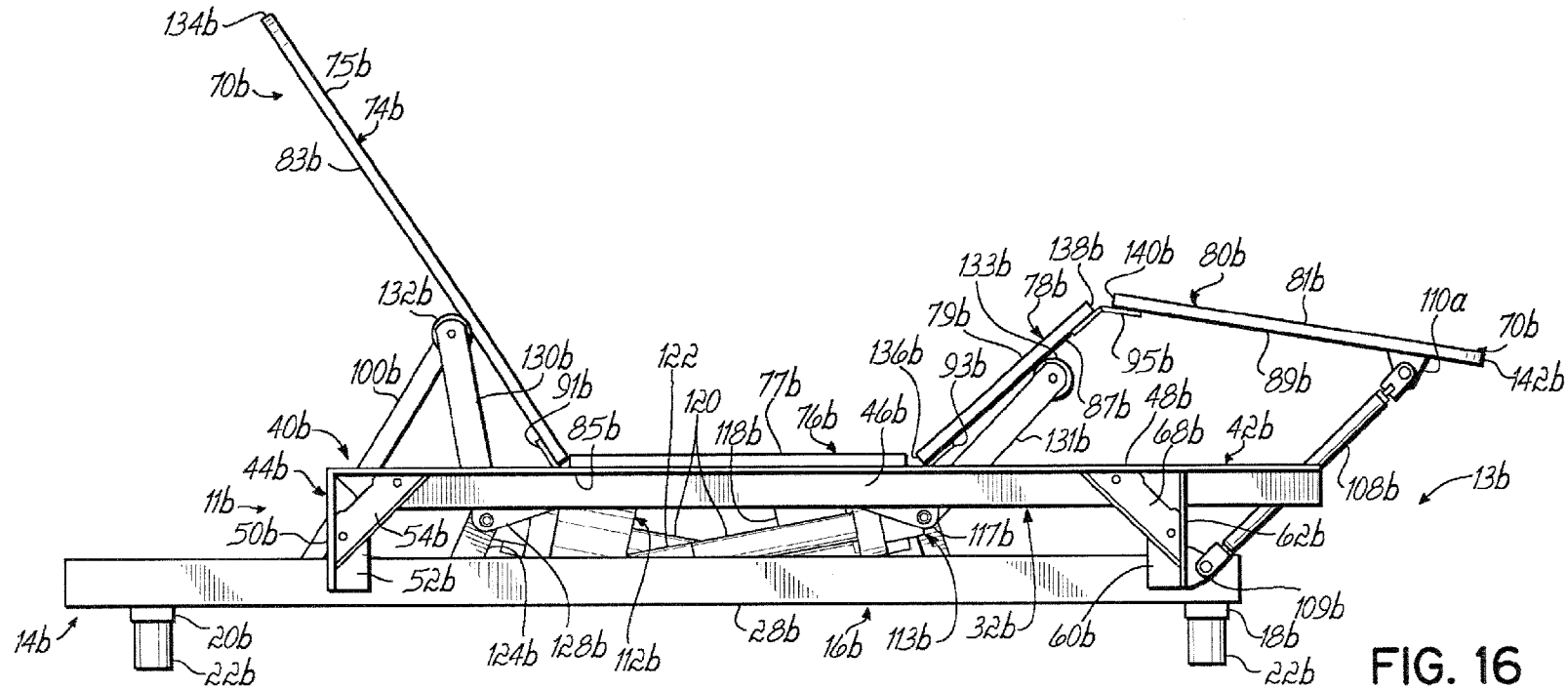
FIG. 16 is a side elevational view of the adjustable bed of FIG. 9 without the mattress in a fully inclined position.

As illustrated in FIGS. 13, 15 and 16, two foot links 108*b* or connectors, each of the same fixed length, are each pivotally secured at a lower end to one of the rear legs 60*b* of the side assemblies 34*b* of the frame 32*b* with fastener 109*b* so that each pivots about a horizontal pivot axis. See FIG. 13. Each foot link 108*b* is pivotally secured at its upper end to a bracket 110*b* fixed to the lower surface 89*b* of the foot deck board 80*b*.

The articulated deck 70*b* is moved by two motorized linear actuator assemblies 112*b*, 113*b* between a first position shown in FIG. 15 in which the deck boards 74*b*, 76*b*, 78*b* and 80*b* are generally co-planar in a horizontal position or orientation and a second position shown in FIGS. 13, 15 and 16. In the second position, the head deck board 74*b* is inclined, the seat deck board 76*b* is substantially horizontal and fixed to the frame 32*b*, the leg deck board 78*b* inclined and the foot deck board 80*b* slightly inclined.

In this embodiment of adjustable bed 10*b*, the first motorized linear actuator assembly 112*b* comprises a first motorized linear actuator 114*b* secured to a first rotatable or pivotal torque tube 116*b* of frame 32*b* by a snap-fit connector 150 like the one illustrated in FIGS. 5-7. The first torque tube 116*b* is secured to and extends between two brackets 117*b*. Each bracket 117*b* is secured to a vertical flange 46*b* of the horizontal portion 42*b* of one of the generally L-shaped members 40*b* of one of the side assemblies 34*b* of the frame 32*b*. Thus, one end of the first motorized linear actuator 114*b* is mounted to the first torque tube 116*b* which forms part of the frame 32*b*.

The first motorized linear actuator 114*b* is identical to the motorized linear actuator 114 shown in detail in FIGS. 5-8 and comprises an AC motor 118 protected by housing 158, a housing tube 120 and an extension tube 122 extendable from inside the housing tube 120 in the manner described above and shown in the drawings.

The first motorized linear actuator assembly 112*b* further comprises a snap-fit connector 152 secured to the end of extension tube 122 and receivable over a pin 154 extending between a pair of spaced link arms 124*b* (see FIGS. 13-16). Each link arm 124*b* is welded or secured at its upper end to a second rotatable torque tube 126*b* so that the torque tube 126*b* is pivotally secured to the extension tube 122 of the motorized linear actuator 114*b* through the snap-fit connector 152 and pin 154. The second torque tube 126*b* is, in turn, mounted between brackets 128*b*, each bracket 128*b* being secured to a vertical flange 46*b* of the horizontal portion 42*b* of the generally L-shaped member or rail 40*b* of one of the side assemblies 34*b* of the frame 32*b*. Thus, the second torque tube 126*b* is part of the first motorized linear actuator assembly 112*b*. The second torque tube 126*b* has a pair of spaced operating arms 130*b* extending upwardly therefrom, each arm 130*b* being a fixed length and having a roller 132*b* at the end thereof for engaging the lower surface 83*b* of the head deck board 74*b*. See FIGS. 13 and 16. Each operating arm 130*b* is welded or otherwise fixedly secured to the second torque tube 126*b* at its lower end.

The second motorized linear actuator assembly 113*b* comprises a second motorized linear actuator 115*b* secured to second torque tube 126*b* of the frame 32*b* by a snap-fit connector 150 as illustrated in FIGS. 5-7. The second motorized linear actuator 115*b* comprises an AC motor 118 in a housing 158, a housing tube 120 and an extension tube 122 extendable from inside the housing tube 120 in the manner described above and shown in the drawings.

The second motorized linear actuator assembly 113*b* further comprises a snap-fit connector 152 secured to the end of extension tube 122 and receivable over a pin 154 extending between a pair of spaced link arms 125*b* (see FIGS. 13-16). Each link arm 125*b* is welded or secured at its upper end to first rotatable torque tube 116*b* so that the first torque tube 116*b* is pivotally secured to the extension tube 122 of the second motorized linear actuator 115*b* through the snap-fit connector 152 and pin 154. The first torque tube 116*b* is, in turn, mounted between brackets 128*b*, each bracket 128*b* being secured to a vertical flange 46*b* of the horizontal portion 42*b* of the generally L-shaped member or rail 40*b* of one of the side assemblies 34*b* of the frame 32*b*. The first torque tube 116*b* has a pair of spaced operating arms 131*b* extending upwardly therefrom, each arm 131*b* being a fixed length and having a roller 133*b* at the end thereof for engaging the lower surface 83*b* of the leg deck board 78*b*. See FIG. 16. Each operating arm 131*b* is welded or otherwise fixedly secured to the first torque tube 116*b* at its lower end.

Although I have described one preferred embodiment of the invention, I do not intend to be limited except by the scope of the following claims.

I claim:

1. An adjustable bed comprising:

a stationary base having a pair of opposed side rails, each of said side rails including a channel having a "C-shaped" cross-sectional configuration;

a frame movable relative to said stationary base, said frame including a pair of side assemblies and a pair of cross members;

rollers rotatably mounted to said side assemblies of said frame and being rotatable in said channels of said side rails of said base;

a seat deck board secured to said movable frame;

a head deck board hingedly secured to said seat deck board;

a leg deck board hingedly secured to said seat deck board;

a foot deck board hingedly secured to said leg deck board;

a pair of head links of a fixed length, each of said head links being pivotally secured to one of said side rails of said base at one end and being pivotally secured to brackets secured to said head deck board at the other end;

a pair of leg links of a fixed length, each of said leg links being pivotally secured to frame at one end and being pivotally secured to brackets secured to said leg deck board at the other end;

a first motorized linear actuator assembly secured by first and second snap-fit connectors to said frame, said first motorized linear actuator assembly including a motor, a housing, a housing tube, an extension tube movable relative to said housing tube, a first snap-fit connector secured to the housing and a second snap-fit connector secured to an end of the extension tube, said extension tube being operatively coupled by the second snap-fit connector to a first pair of link arms operative coupled to a first torque tube, said first torque tube being operatively coupled to a pair of operating arms having rollers at the ends therefor for engaging said head deck board to raise the head board and said first snap-fit connector being secured to one of said cross members of said frame wherein said second snap fit connector has a slot adapted to receive a pin extending between the first pair of link arms.

2. The adjustable bed of claim 1 further comprising a second motorized linear actuator assembly secured by snap-fit connectors to said frame, said second motorized linear actuator assembly including a housing tube and an extension tube movable relative to said housing tube, said extension tube being operatively coupled by a snap-fit connector to a second pair of link arms operative coupled to a second torque tube, said second torque tube being operatively coupled to a pair of operating arms having rollers at the ends therefor for engaging said leg deck board to incline the leg deck board.

3. An adjustable bed comprising:

a stationary base having a pair of opposed side rails; a frame movable relative to said stationary base, said frame including a pair of side assemblies and a pair of cross members;

rollers rotatably mounted to said side assemblies of said frame and being rotatable on said side rails of said base;

a seat deck board secured to said frame;

a head deck board hingedly secured to said seat deck board and operatively coupled to said base with links of a fixed length;

a leg deck board hingedly secured to said seat deck board and operatively coupled to said base with links of a fixed length;

a foot deck board hingedly secured to said leg deck board and operatively coupled to said frame with links of a fixed length; and a pair of motorized linear actuator assemblies for moving said head, leg and foot deck boards between a horizontal position and an inclined position and moving said frame relative to said stationary base, each of said motorized linear actuator assemblies comprising a linear actuator having one end connected by a first snap-fit connector to one of said cross members of said movable frame and an opposite end connected by a second snap-fit connector to a component operative when moved to effect movement of at least one of said head, leg and foot deck boards between said horizontal position and said inclined position wherein said second snap fit connector has a slot adapted to receive a pin extending between a pair of link arms operatively coupled to a rotatable torque tube of said frame.

4. The adjustable bed of claim 3 wherein said linear actuator includes a housing tube secured to said frame and a extension tube movable relative to said housing tube, said extension tube being operatively coupled by said second snap-fit connector to a pair of link arms operatively coupled to a torque tube, said torque tube being operatively coupled to a pair of operating arms having rollers at the ends therefor for engaging one said deck boards to raise the deck board.

5. The adjustable bed of claim 3 further comprising links extending between said head deck board and said base, said links being pivotally secured to one of said side rails of said stationary base at one end and pivotally secured to brackets secured to said head deck board at the other end.

6. The adjustable bed of claim 3 wherein further comprising links extending between said foot deck board and said movable frame, said links being pivotally secured to said movable frame at one end and pivotally secured to brackets secured to said foot deck board at the other end.

7. An adjustable bed comprising:

a stationary base having a pair of opposed side rails, a head end rail and a foot end rail;

a frame spaced above said stationary base and movable relative to said stationary base;

an articulated deck comprising a head deck board, a seat deck board, a leg deck board and a foot deck board hingedly joined to each other, said seat deck board being fixedly secured to said frame;

head links of a fixed length pivotally secured to said side rails of said base and pivotally secured to brackets secured to said head deck board; and a pair of motorized linear actuator assemblies for moving said frame relative to said stationary base, each of said motorized linear actuator assemblies comprising a linear actuator having one end connected by a first snap-fit connector to a cross member of said movable frame and an opposite end connected by a second snap-fit connector to a component operative when moved to effect movement of at least one of said head, leg and foot deck boards between said horizontal position and said inclined position wherein said second snap fit connector has a slot adapted to receive a pin extending between a pair of link arms operatively coupled to a rotatable torque tube of said frame.

8. The adjustable bed of claim 1 wherein said first snap fit connector is made of plastic.

9. The adjustable bed of claim 1 wherein said snap fit connectors are made of plastic.

10. The adjustable bed of claim 3 wherein said first snap fit connector is made of plastic.

11. The adjustable bed of claim 3 wherein said snap fit connectors are made of plastic.

12. An adjustable bed comprising:

a stationary base having a pair of opposed side rails, each of said side rails including a channel having a "C-shaped" cross-sectional configuration;

a frame movable relative to said stationary base, said frame including a pair of side assemblies and rollers rotatably mounted to said side assemblies of said frame and being rotatable in said channels of said side rails of said base;

a seat deck board secured to said movable frame;

a head deck board hingedly secured to said seat deck board;

a leg deck board hingedly secured to said seat deck board;

a foot deck board hingedly secured to said leg deck board;

a pair of head links, each of said head links being pivotally secured to one of said side rails of said base at one end and being pivotally secured to brackets secured to said head deck board at the other end;

a pair of leg links, each of said leg links being pivotally secured to frame at one end and being pivotally secured to brackets secured to said leg deck board at the other end;

a first actuator secured by snap-fit connectors to said frame, said actuator including a housing tube and an extension tube movable relative to said housing tube, said extension tube being operatively coupled by a snap-fit connector to a pin extending between a first pair of link arms operative coupled to a first torque tube, said first torque tube being operatively coupled to a pair of operating arms having rollers at the ends therefor for engaging said head deck board to raise the head board.

13. The adjustable bed of claim 12 further comprising a second actuator secured by snap-fit connectors to said frame, said second actuator including a housing tube and an extension tube movable relative to said housing tube, said extension tube being operatively coupled by a snap-fit connector to a second pair of link arms operative coupled to a second torque tube, said second torque tube being operatively coupled to a pair of operating arms having rollers at the ends therefor for engaging said leg deck board to incline the leg deck board.

14. The adjustable bed of claim 12 wherein said snap fit connectors are made of plastic.

15. The adjustable bed of claim 13 wherein said snap fit connectors are made of plastic.

* * * * *

UNITED STATES PATENT AND TRADEMARK OFFICE

CERTIFICATE OF CORRECTION

PATENT NO. : 7,900,302 B2
APPLICATION NO. : 11/870148
DATED : March 8, 2011
INVENTOR(S) : Thomas P. Long It is certified that error appears in the above-identified patent and that said Letters Patent is hereby corrected as shown below:

Column 2

Line 19, “assemblies” should be --assembly--.

Column 3

Line 16, “affects” should be --effects--.

Line 54, “is facilitated” should be --are facilitated--.

Line 60, “non wall hugger” should be --nonwall hugger--.

Column 5

Line 35, “are joined” should be --is joined--.

Column 9

Line 61, “11 a” should be --11a--.

Column 10

Line 39, “are joined” should be --is joined--.

Column 15

Line 13, remove the “,” after “Although”.

Column 17

Line 16, “secured to frame” should be --secured to said frame--.

Line 27, “operative” should be --operatively--.

Signed and Sealed this
Seventh Day of June, 2011

David J. Kappos

David J. Kappos
*Director of the United States Patent and Trademark Office*

Line 42, “operative” should be --operatively--.

Column 18

Line 24, delete “wherein”.

Column 19

Line 12, “secured to frame” should be --secured to said frame--.

Column 20

Line 1, “operative” should be --operatively--.

Line 10, “operative” should be --operatively--.